US011322829B2

(12) United States Patent
Jia

(10) Patent No.: US 11,322,829 B2
(45) Date of Patent: May 3, 2022

(54) ANTENNA ASSEMBLY AND ELECTRONIC DEVICE

(71) Applicant: GUANGDONG OPPO MOBILE TELECOMMUNICATIONS CORP., LTD., Guangdong (CN)

(72) Inventor: Yuhu Jia, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 0 days.

(21) Appl. No.: 16/833,607

(22) Filed: Mar. 29, 2020

(65) Prior Publication Data

US 2020/0321691 A1 Oct. 8, 2020

(30) Foreign Application Priority Data

Apr. 8, 2019 (CN) ..... 201910283830.2

(51) Int. Cl.
*H01Q 1/38* (2006.01)

(52) U.S. Cl.
CPC ..... *H01Q 1/38* (2013.01)

(58) Field of Classification Search
None
See application file for complete search history.

(56) References Cited

U.S. PATENT DOCUMENTS

2004/0104852 A1 6/2004 Choi et al.
2010/0066631 A1 3/2010 Puzella et al.
2012/0044113 A1* 2/2012 Satoh ..... H01Q 1/38 343/702
2014/0132473 A1* 5/2014 Isom ..... H01Q 9/0421 343/855
2016/0344098 A1* 11/2016 Ming ..... H01Q 3/34
(Continued)

FOREIGN PATENT DOCUMENTS

CN 102377021 3/2012
CN 102931454 2/2013
(Continued)

OTHER PUBLICATIONS

SIPO, First Office Action for CN Application No. 201910283830.2, dated Mar. 23, 2020.
(Continued)

*Primary Examiner* — Crystal L Hammond
(74) *Attorney, Agent, or Firm* — Hodgson Russ LLP

(57) ABSTRACT

An antenna assembly and an electronic device are provided according to the present disclosure. The antenna assembly includes an antenna module and a bandwidth matching layer. The antenna module is configured to transmit and receive, within a preset direction range, a millimeter wave signal in a target frequency band. The bandwidth matching layer is spaced apart from the antenna module, and at least part of the bandwidth matching layer is disposed within the preset direction range. The bandwidth matching layer is configured to match an impedance of the antenna module to an impedance of free space to enable an impedance bandwidth of the antenna module in the target frequency band when the bandwidth matching layer is provided to be greater than an impedance bandwidth of the antenna module in the free space.

18 Claims, 16 Drawing Sheets

(56) References Cited

U.S. PATENT DOCUMENTS

| | | | | |
|---|---|---|---|---|
| 2018/0233808 | A1 | 8/2018 | Noori et al. | |
| 2019/0027804 | A1* | 1/2019 | Kim | H01Q 21/0025 |
| 2020/0052367 | A1 | 2/2020 | Zhu et al. | |

FOREIGN PATENT DOCUMENTS

| | | |
|---|---|---|
| CN | 102931491 | 2/2013 |
| CN | 104685578 | 6/2015 |
| CN | 105703066 | 6/2016 |
| CN | 108432041 | 8/2018 |
| CN | 108463922 | 8/2018 |
| CN | 109088180 | 12/2018 |
| CN | 109103589 | 12/2018 |
| WO | 2018206116 | 11/2018 |

OTHER PUBLICATIONS

ISA/CN, Written Opinion of the International Searching Authority in IA No. PCT/CN2020/081915, dated Jun. 30, 2020, 10 pages.

EPO, Extended European Search Report in EP App. No. 20166429.9, dated Aug. 26, 2020, 9 pages.

3GPP Organizational Partners, "User Equipment (UE) radio transmission and reception; Part 2: Range 2 Standalone (Release 16)," 3GPP TSG-RAN NR TS38.101-2 v16.4.0, 2020, 171 pages.

3GPP Organizational Partners, "Study on new radio access technology: Radio Frequency (RF) and co-existence aspects (Release 14)," 3GPP TSG-RAN TR38.803 V14.2.0, 2017, 204 pages.

Zheng, Zhi et al., "Using homogenous dielectric superstrate to enhance the bandwidth of a microstrip antenna," J. Sichuan Univ. vol. 53(2), Mar. 2016, pp. 326-330.

Al-Alem, Yazan et al., "Antenna Gain and Bandwidth Enhancement Using a Dielectric Superstrate at 60 GHz," 2018 18th International Symposium on Antenna Technology and Applied Electromagnetics (ANTEM), Dec. 13, 2018, 3 pages.

Vettikalladi, Hamsakutty et al., "High-Efficient and High-Gain Superstrate Antenna for 60-GHz Indoor Communication," IEEE Antennas and Propagation Wireless L. vol. 8, Jan. 26, 2010, pp. 1422-1425.

SIPO, Second Office Action in CN App. No. 201910283830.2, dated Sep. 9, 2020, 39 pages (including translation).

IPI, Office Action for IN Application No. 202014014223, dated Jun. 10, 2021.

* cited by examiner

ANTENNA ASSEMBLY AND ELECTRONIC DEVICE

CROSS-REFERENCE TO RELATED APPLICATION

This application claims priority to Chinese Patent Application No. 201910283830.2, filed Apr. 8, 2019, the entire disclosure of which is incorporated herein by reference.

TECHNICAL FIELD

This disclosure relates to the field of electronic devices, and in particular, to an antenna assembly and an electronic device.

BACKGROUND

With the development of mobile communication technology, the traditional fourth generation (4G) mobile communication cannot meet user requirements. The fifth generation (5G) mobile communication is favored by the users as the 5G mobile communication can provide a high communication speed. For example, a data transmission speed in the 5G mobile communication is hundreds of times higher than that in the 4G mobile communication. The 5G mobile communication is mainly implemented via millimeter wave signals. However, an inherent characteristic of an antenna (for example, a microstrip antenna) for transmitting and receiving the millimeter-wave signals is that a frequency band of the antenna is narrow, where the frequency band is mainly limited due to an impedance of the antenna.

SUMMARY

An antenna assembly is provided according to the present disclosure. The antenna assembly includes an antenna module and a bandwidth matching layer. The antenna module is configured to transmit and receive, within a preset direction range, a millimeter wave signal in a target frequency band. The bandwidth matching layer is spaced apart from the antenna module, and at least part of the bandwidth matching layer is disposed within the preset direction range. The bandwidth matching layer is configured to match an impedance of the antenna module to an impedance of free space to enable an impedance bandwidth of the antenna module in the target frequency band when the bandwidth matching layer is provided to be greater than an impedance bandwidth of the antenna module in the free space.

An electronic device is further provided according to the present disclosure. The electronic device includes the aforementioned antenna assembly. The bandwidth matching layer includes a battery cover or a screen of the electronic device.

An electronic device is further provided according to the present disclosure. The electronic device includes a first antenna module, a second antenna module, and a bandwidth matching layer. The first antenna module is configured to transmit and receive, within a first preset direction range, a millimeter wave signal in a first target frequency band. The second antenna module is spaced apart from the first antenna module, and the second antenna module is disposed outside the first preset direction range. The second antenna module is configured to transmit and receive, within a second preset direction range, a millimeter wave signal in a second target frequency band. The bandwidth matching layer is spaced apart from the first antenna module and the second antenna module, and the bandwidth matching layer is at least partially within the first preset direction range and at least partially within the second preset direction range. The bandwidth matching layer is configured to match the impedance of the first antenna module to the impedance of the free space to enable an impedance bandwidth of the first antenna module in the first target frequency band when the bandwidth matching layer is provided to be greater than an impedance bandwidth of the first antenna module in the free space and an impedance bandwidth of the second antenna module in the second target frequency band when the bandwidth matching layer is provided to be greater than an impedance bandwidth of the second antenna module in the free space. In an implementation, the bandwidth matching layer includes a battery cover or a screen of the electronic device.

BRIEF DESCRIPTION OF THE DRAWINGS

To describe technical solutions in the implementations of the present disclosure more clearly, the following briefly introduces the accompanying drawings required for describing the implementations. Apparently, the accompanying drawings in the following description merely illustrate some implementations of the present disclosure. Those of ordinary skill in the art may also obtain other obvious variations based on these accompanying drawings without creative efforts.

DETAILED DESCRIPTION

The technical solutions in the implementations of the present disclosure are clearly and completely described in the following with reference to the accompanying drawings in the implementations of the present disclosure. Apparently, the described implementations are merely a part of rather than all the implementations of the present disclosure. All other implementations obtained by those of ordinary skill in the art based on the implementations of the present disclosure without creative efforts are within the scope of the present disclosure.

Figure 1:
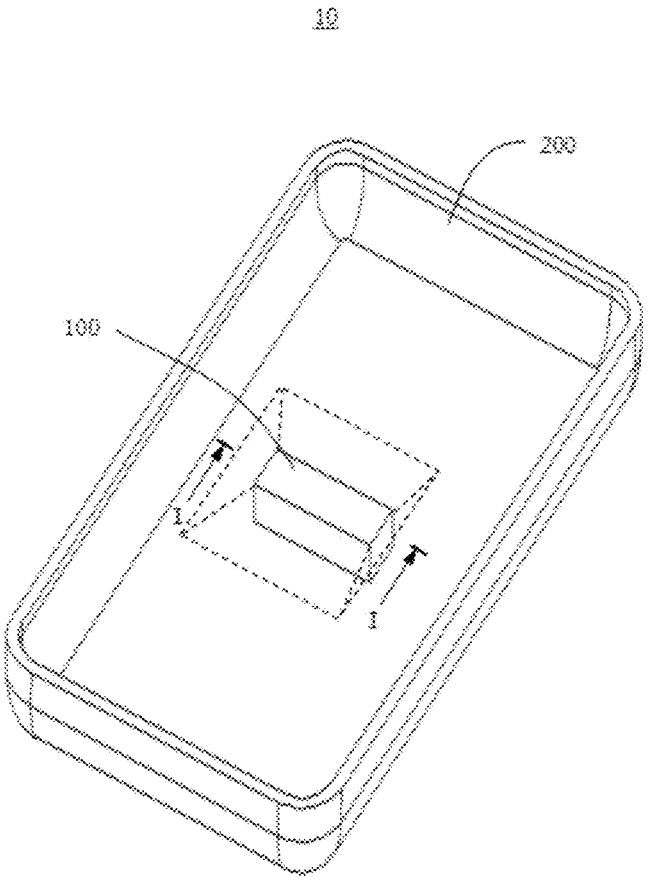
FIG. 1 is a schematic structural view of an antenna assembly according to an implementation of the present disclosure.
Figure 2:
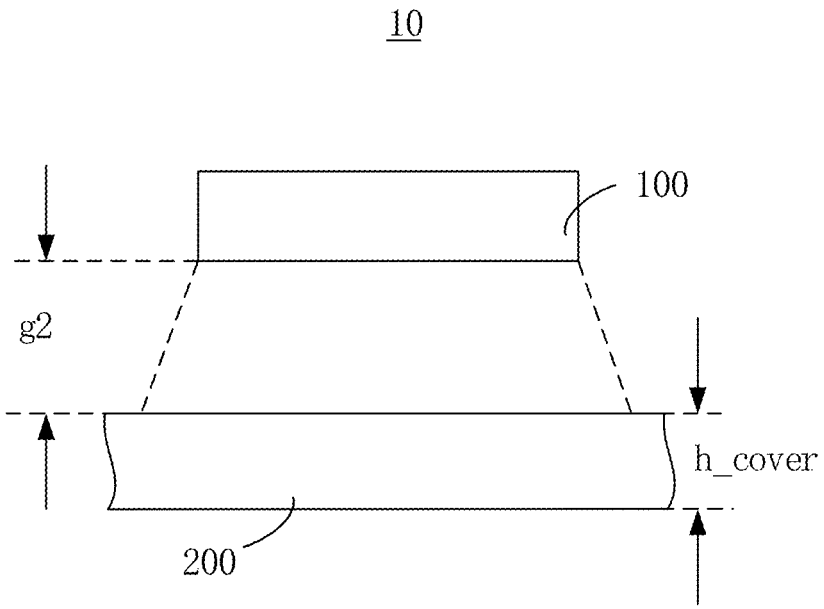
FIG. 2 is a schematic cross-sectional structural view of the antenna assembly according to the present disclosure, taken along a line I-I.

FIG. 1 is a schematic structural view of an antenna assembly 10 according to an implementation of the present disclosure. FIG. 2 is a schematic cross-sectional structural view of the antenna assembly 10 according to an implementation of the present disclosure, taken along a line I-I. Only a part of a bandwidth matching layer 200 is schematically illustrated in FIG. 2 for convenience. The antenna assembly 10 includes an antenna module 100 and the bandwidth matching layer 200. The antenna module 100 is configured to transmit and receive, within a preset direction range, a millimeter wave signal in a target frequency band. The bandwidth matching layer 200 is spaced apart from the antenna module 100, and at least part of the bandwidth matching layer 200 is disposed within the preset direction range. The bandwidth matching layer 200 is configured to match an impedance of the antenna module 100 to an impedance of free space to enable an impedance bandwidth of the antenna module 100 in the target frequency band when the bandwidth matching layer 200 is provided to be greater than an impedance bandwidth of the antenna module 100 in the free space. In the implementations of the present disclosure, the preset direction range refers to a radiation range of the antenna module 100, where the antenna module 100 transmits and receives the millimeter wave signals within the radiation range. As an example, the preset direction range is defined by dashed lines in FIG. 1, and it is noted that an orthographic projection of the preset direction range to the bandwidth matching layer 200 is not limited to a rectangle as illustrated in FIG. 1, which is merely illustrated for descriptive purposes.

As illustrated in FIG. 2, the preset direction range is defined by two dashed lines. In FIG. 2, the bandwidth matching layer 200 is partially within the preset direction range. It is noted that, in other implementations, the bandwidth matching layer 200 may be fully within the preset direction range.

An equivalent impedance of the millimeter wave signal generated by the antenna module 100 can be represented by a real part and an imaginary part, and the equivalent impedance generated when the bandwidth matching layer 200 is provided is different from an impedance in free space. Radiation from a radiating surface of the antenna module 100 to the free space is regarded as a transmission line, and thus an impedance of an equivalent transmission line of the millimeter wave signal can be designed in space, thereby achieving bandwidth impedance match for the antenna module 100. The antenna module 100 of the present disclosure transmits and receives, within the preset direction range, the millimeter wave signal in the target frequency band, the bandwidth matching layer 200 is spaced apart from the antenna module 100, and the bandwidth matching layer 200 is at least partially disposed within the preset direction range, and thus the bandwidth matching layer 200 can match the impedance of the antenna module 100 to the impedance of the free space to enable the impedance bandwidth of the antenna module 100 in the target frequency band when the bandwidth matching layer 200 is provided to be greater than the impedance bandwidth of the antenna module 100 in the free space, thereby improving the communication quality when the antenna assembly 10 is used for communication.

Further, in an implementation of the present disclosure, by providing the antenna assembly 10 with the bandwidth matching layer 200 spaced apart from the antenna module 100, the bandwidth matching layer 200 can match the impedance of the antenna module 100 to the impedance of the free space, such that the impedance bandwidth of the antenna module 100 in the target frequency band when the bandwidth matching layer 200 is provided is greater than the impedance bandwidth of the antenna module 100 in the free space. Compared with a conventional antenna module manufactured only through a high density interconnect (HDI) process, i.e., without usage of the bandwidth matching layer 200, the antenna module 100 of the present disclosure may be designed to be relatively thin, thereby facilitating the lightness and thinness of the antenna module 100.

Further, a correspondence relationship among a thickness of the bandwidth matching layer 200, a dielectric constant of the bandwidth matching layer 200, and a wavelength of the millimeter wave signal in the target frequency band is defined in a Formula (1).

$$\frac{\lambda}{2\sqrt{Dk}} > \text{h_cover} \geq \frac{\lambda}{2\pi(Dk-1)} \qquad \text{Formula (1)}$$

In the Formula (1), h_cover represents the thickness of the bandwidth matching layer 200, Dk represents the dielectric constant of the bandwidth matching layer 200, and λ represents the wavelength of the millimeter wave signal in the target frequency band. An example that the target frequency band of the millimeter wave signal is a band N261 is given below to illustrate the correspondence between bandwidth matching layers of different thicknesses and the millimeter wave signals of different wavelengths in the target frequency band. The target frequency band of the millimeter wave signal being the band N261 means that the millimeter wave signal is in a target frequency band of 27.5 GHz-28.35 GHz. For the antenna module 100 (the dielectric substrate 120 in FIG. 11 having a stacked structure of eight layers is taken as an example, and for the dielectric substrate 120, a core layer 121 has a thickness of 0.1 mm, and an insulating layer 123 on each wiring layer 122 has a thickness of 0.05 mm), when the antenna module 100 in the free space has a center frequency of 28 GHz, the antenna module 100 has an impedance bandwidth (that is, a frequency range at which a return loss S11 is less than or equal to −10 dB) of 880 MHz and a fractional bandwidth of only 3.1%. In this example, the fractional bandwidth is equal to a ratio of the impedance bandwidth to the center frequency and is a normalized value. Bandwidths of millimeter-wave signals that resonate at different frequencies are usually compared by comparing fractional bandwidths. It is noted that when the antenna module 100 is in the free space, the antenna module 100 is not covered by the bandwidth matching layer 200.

Figure 3:
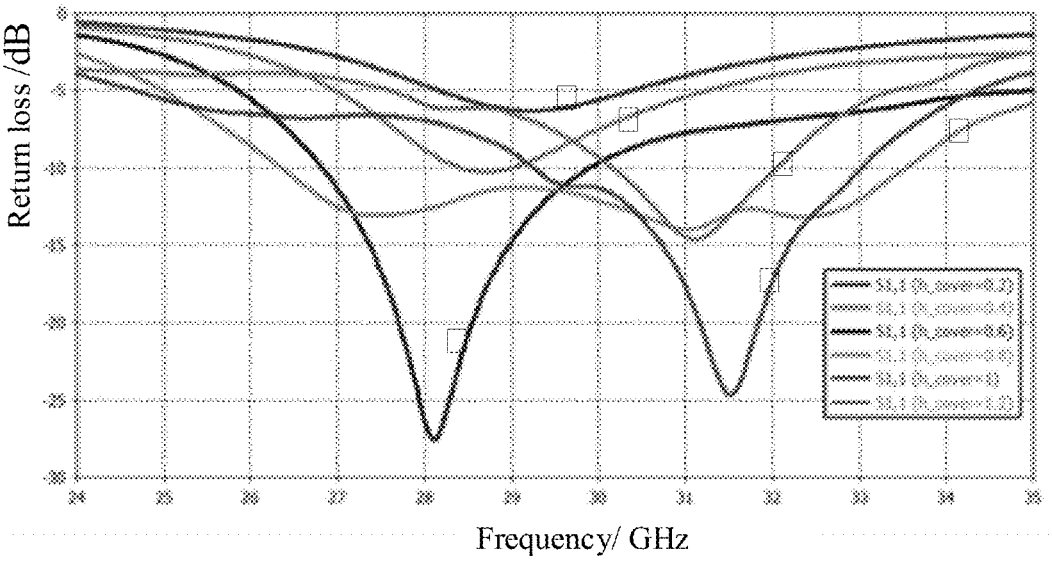
FIG. 3 illustrates a simulation graph of impedance bandwidths of millimeter wave signals in a band N261 corresponding to bandwidth matching layers of different thicknesses.

When the millimeter wave signal is in the band N261, and the thickness of the bandwidth matching layer 200 falls within a range from 0.5 mm to 1.2 mm. FIG. 3 illustrates a simulation graph of return losses of the millimeter wave signals in the band N261 corresponding to the bandwidth matching layers 200 of different thicknesses. In FIG. 3, the horizontal axis represents a frequency of a millimeter wave signal in units of GHz, and the vertical axis represents a return loss S11 in units of dB. In FIG. 3, a frequency of the millimeter wave signal corresponding to the lowest point in each curve indicates that when the antenna module 100 operates at this frequency, the millimeter wave signal has the smallest return loss. That is, the frequency corresponding to the lowest point in each curve is the center frequency of the millimeter wave signal. FIG. 3 illustrates six curves. A curve ① is a simulation curve of the return loss S11 of the antenna assembly 10 when the bandwidth matching layer 200 has the thickness of 0.2 mm. A curve ② is a simulation curve of the return loss S11 of the antenna assembly 10 when the bandwidth matching layer 200 has the thickness of 0.4 mm. A curve ③ is a simulation curve of the return loss S11 of the antenna assembly 10 when the bandwidth matching layer 200 has the thickness of 0.6 mm. A curve ④ is a simulation curve of the return loss S11 of the antenna assembly 10 when the bandwidth matching layer 200 has the thickness of 0.8 mm. A curve ⑤ is a simulation curve of the return loss S11 of the antenna assembly 10 when the bandwidth matching layer 200 has the thickness of 1.0 mm. A curve ⑥ is a simulation curve of the return loss S11 of the antenna assembly 10 when the bandwidth matching layer 200 has the thickness of 1.2 mm. For each curve, the frequency range corresponding to the return loss S11 of less than or equal to −10 dB is operated as the impedance bandwidth of the millimeter wave signal generated by the antenna assembly 10 with the bandwidth matching layer 200 of a corresponding thickness. For example, referring to the curve ③ in FIG. 3, when the millimeter wave signal is in the band N261 and the bandwidth matching layer 200 has the thickness of 0.6 mm, the center frequency of the millimeter wave signal is 28 GHz, and the frequency range at which the return loss S11 is less than or equal to −10 dB is 3.1 GHz, that is, the impedance bandwidth of the millimeter wave signal is 3.1 GHz, and the fractional bandwidth is the ratio of the impedance bandwidth to the center frequency, i.e., the fractional bandwidth is equal to 11% calculated by (3.1 GHz/28 GHz)*100%, and the fractional bandwidth of the antenna assembly 10 with the bandwidth matching layer 200 is about 3.55 times (11%/3.1%≈3.55) the fractional bandwidth of the antenna assembly 10 in the free space. Referring to the curve ④ in FIG. 3, when the millimeter wave signal is in the band N261 and the bandwidth matching layer 200 has the thickness of 0.8 mm, the impedance bandwidth of the millimeter wave signal is 3.1 GHz, and the fractional bandwidth is 24% and about eight times the fractional bandwidth of the antenna assembly 10 in the free space. As seen in FIG. 3, when the thickness of the bandwidth matching layer 200 is 0.6 mm, 0.8 mm, 1.0 mm, or 1.2 mm, the impedance bandwidth of the millimeter wave signal is relatively large.

Figure 4:
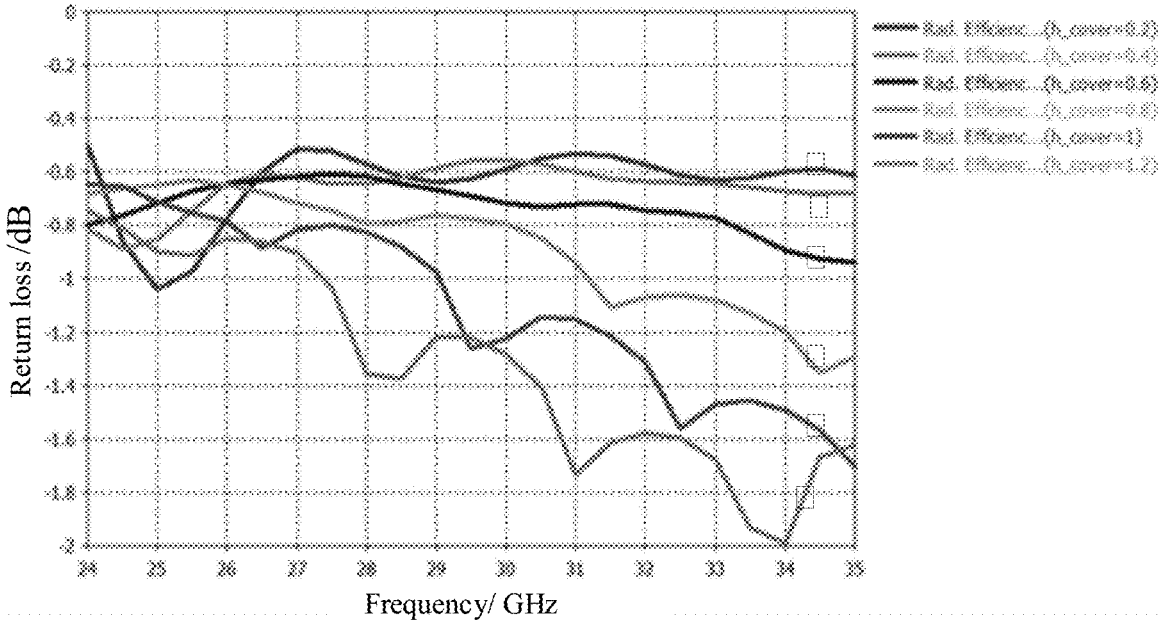
FIG. 4 illustrates a simulation graph of radiation efficiencies of millimeter wave signals in the band N261 corresponding to bandwidth matching layers of different thicknesses.

An example that the target frequency band of the millimeter wave signal is the band N261 is given below to illustrate the correspondence between the bandwidth matching layers of different dielectric constants and the millimeter wave signals of different wavelengths in the target frequency band. FIG. 4 illustrates a simulation graph of radiation efficiencies of the millimeter wave signals in the band N261 corresponding to bandwidth matching layers of different thicknesses. In FIG. 4, the horizontal axis represents a frequency of a millimeter wave signal in units of GHz, and the vertical axis represents a return loss S11 in units of dB. A curve ① is a simulation curve of the return loss S11 of the antenna assembly 10 when the bandwidth matching layer 200 has the thickness of 0.2 mm. A curve ② is a simulation curve of the return loss S11 of the antenna assembly 10 when the bandwidth matching layer 200 has the thickness of 0.4 mm. A curve ③ is a simulation curve of the return loss S11 of the antenna assembly 10 when the bandwidth matching layer 200 has the thickness of 0.6 mm. A curve ④ is a simulation curve of the return loss S11 of the antenna assembly 10 when the bandwidth matching layer 200 has the thickness of 0.8 mm. A curve ⑤ is a simulation curve of the return loss S11 of the antenna assembly 10 when the bandwidth matching layer 200 has the thickness of 1.0 mm. A curve ⑥ is a simulation curve of the return loss S11 of the antenna assembly 10 when the bandwidth matching layer 200 has the thickness of 1.2 mm. As can be seen in FIG. 4, the larger the thickness of the bandwidth matching layer 200 is, the lower the high-frequency radiation efficiency is. As seen, for the millimeter-wave signal in the target frequency band which is the band N261 in the implementations of the present disclosure, when the thickness of the bandwidth matching layer 200 falls within a range from 0.5 mm to 1.2 mm, the millimeter-wave signal in the band N261 still has a relatively high radiation efficiency.

Figure 5:
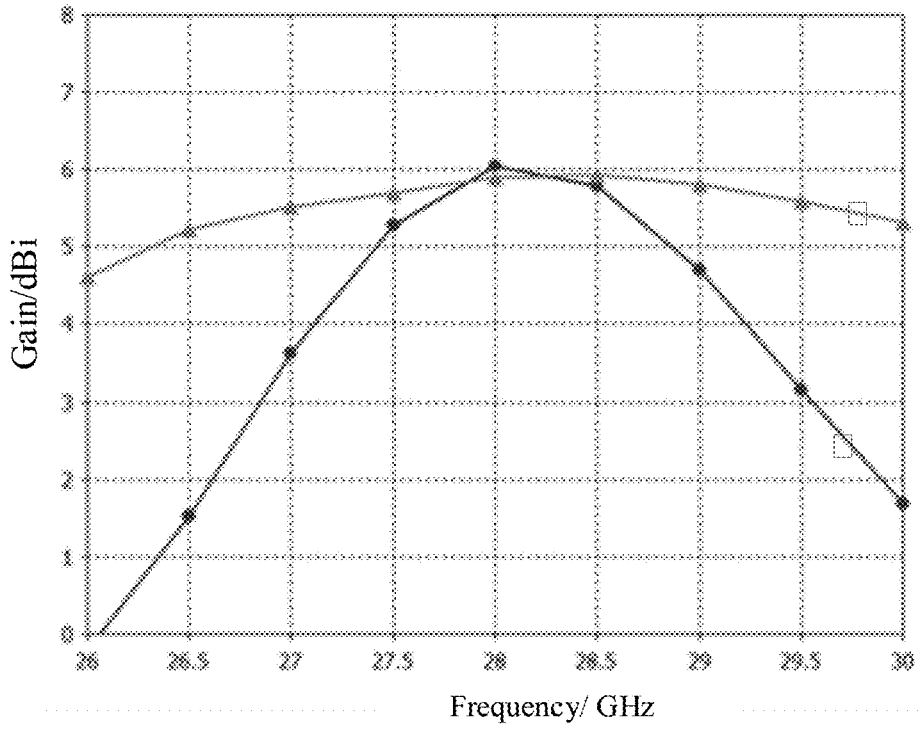
FIG. 5 illustrates a simulation graph of a gain of a millimeter wave signal in the band N261 when a bandwidth matching layer is provided and a gain of a millimeter wave signal in the band N261 when a bandwidth matching layer is absent.

An example that the target frequency band of the millimeter wave signal is the band N261 is given below to illustrate a comparison between a gain of the millimeter wave signal when the bandwidth matching layer 200 is provided and a gain of the millimeter wave signal when the bandwidth matching layer 200 is absent. FIG. 5 is a simulation graph illustrating the gain of the millimeter wave signal in the band N261 when the bandwidth matching layer 200 is provided and the gain of the millimeter wave signal in the band N261 when the bandwidth matching layer 200 is absent. In FIG. 5, the horizontal axis represents a frequency of a millimeter wave signal in units of GHz, and the vertical axis represents a gain in units of dBi. FIG. 5 illustrates two curves. A curve ③ is a simulation curve when the bandwidth matching layer 200 has the thickness of 0.6 mm. A curve ⑦ is a simulation curve when the bandwidth matching layer 200 is absent. As illustrated in FIG. 5, when the bandwidth matching layer 200 has the thickness of 0.6 mm, the millimeter-wave signal in the band N261 still has a relatively high gain.

Figure 6:
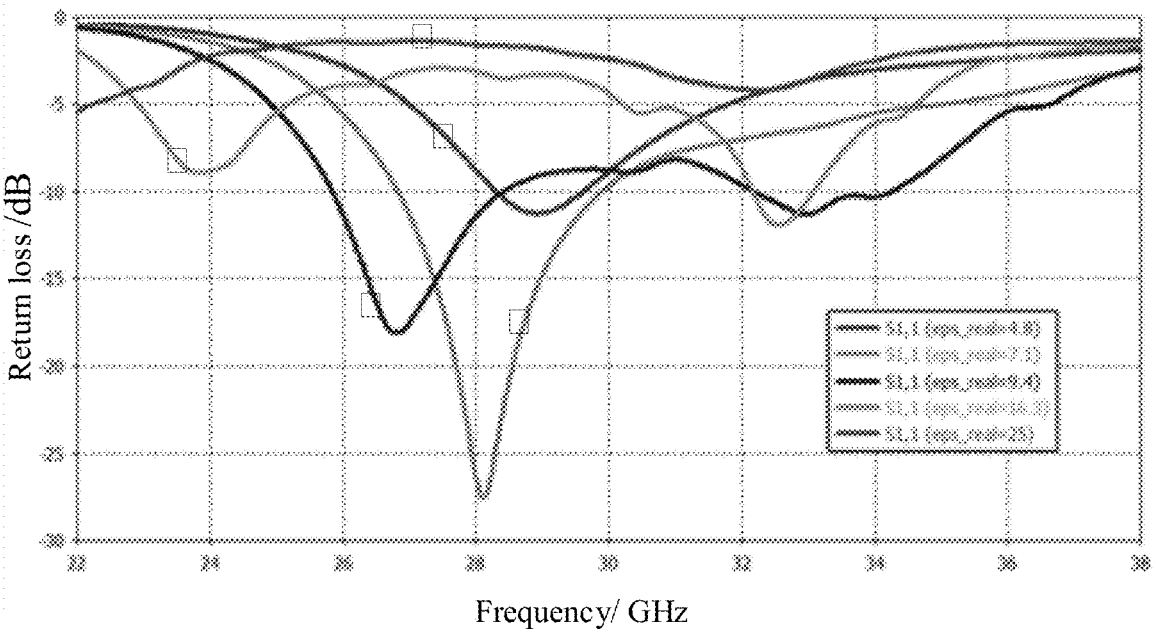
FIG. 6 illustrates a simulation graph of impedance bandwidths of millimeter wave signals in the band N261 corresponding to bandwidth matching layers of different dielectric constants.
Figure 7:
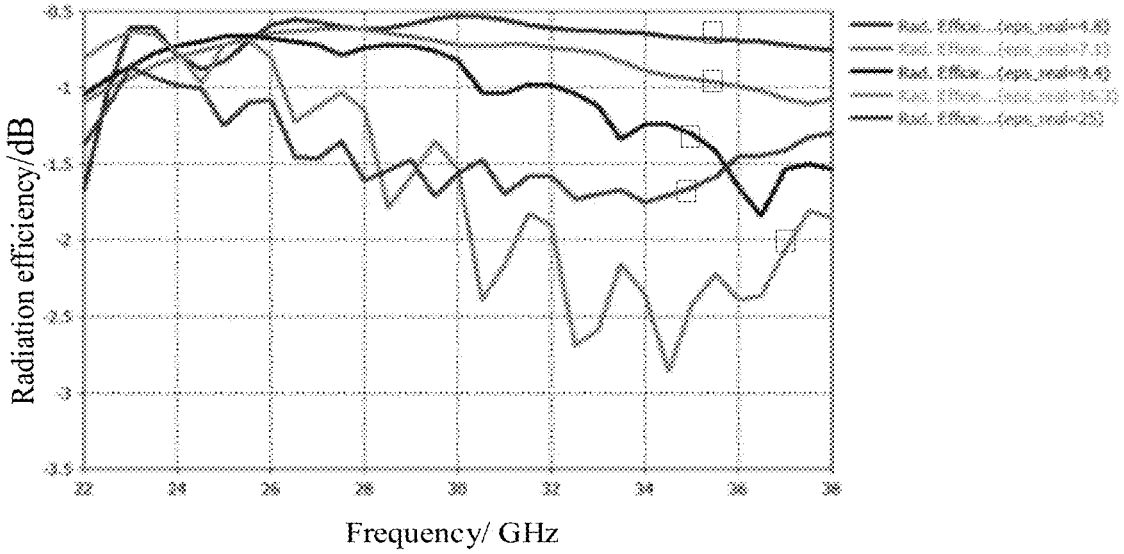
FIG. 7 illustrates a simulation graph of radiation efficiencies of millimeter wave signals in the band N261 corresponding to bandwidth matching layers of different dielectric constants.

Further, for the antenna module 100, a variation in the dielectric constant Dk of the bandwidth matching layer 200 has a significant effect on the bandwidth and the radiation efficiency of the millimeter wave signal radiated by the antenna module 100. An example that the target frequency band of the millimeter wave signal is the band N261 is given below to illustrate the correspondence between the bandwidth matching layers of different dielectric constants and the millimeter wave signals of different wavelengths in the target frequency band. When the millimeter wave signal is in the band N261, the dielectric constant Dk of the bandwidth matching layer 200 falls in a range from 5 to 11. As an example, when the dielectric constant Dk falls in a range from 5 to 11, the bandwidth matching layer 200 is made of a material such as glass, sapphire, or the like. FIG. 6 illustrates a simulation graph of impedance bandwidths of millimeter wave signals in the band N261 corresponding to bandwidth matching layers of different dielectric constants. FIG. 7 illustrates a simulation graph of radiation efficiencies of millimeter wave signals in the band N261 corresponding to the bandwidth matching layers of different dielectric constants. In FIG. 6, the horizontal axis represents a frequency of a millimeter wave signal in units of GHz, and the vertical axis represents a return loss in units of dB. FIG. 6 illustrates five curves. A curve ① is a simulation curve of the return loss S11 of the antenna assembly 10 when the bandwidth matching layer 200 has the dielectric constant of 4.8. A curve ② is a simulation curve of the return loss S11 of the antenna assembly 10 when the bandwidth matching layer 200 has the dielectric constant of 7.1. A curve ③ is a simulation curve of the return loss S11 of the antenna assembly 10 when the bandwidth matching layer 200 has the dielectric constant of 9.4. A curve ④ is a simulation curve of the return loss S11 of the antenna assembly 10 when the bandwidth matching layer 200 has the dielectric constant of 16.3. A curve ⑤ is a simulation curve of the return loss S11 of the antenna assembly 10 when the bandwidth matching layer 200 has the dielectric constant of 25. In FIG. 7, a curve ① is a simulation curve of the radiation efficiency of the antenna assembly 10 when the bandwidth matching layer 200 has the dielectric constant of 4.8. A curve ② is a simulation curve of the radiation efficiency of the antenna assembly 10 when the bandwidth matching layer 200 has the dielectric constant of 7.1. A curve ③ is a simulation curve of the radiation efficiency of the antenna assembly 10 when the bandwidth matching layer 200 has the dielectric constant of 9.4. A curve ④ is a simulation curve of the radiation efficiency of the antenna assembly 10 when the bandwidth matching layer 200 has the dielectric constant of 16.3. A curve ⑤ is a simulation curve of the radiation efficiency of the antenna assembly 10 when the bandwidth matching layer 200 has the dielectric constant of 25. As can be seen in FIG. 7, when the dielectric constant Dk of the bandwidth matching layer 200 is less than 10 and the frequency of the millimeter wave signal is lower than 30 GHz, the radiation efficiency of the millimeter wave signal is above −1 dB, that is, the millimeter wave signal has a relatively high radiation efficiency. When the dielectric constant Dk of the bandwidth matching layer 200 is less than 5, the effect on the space impedance generated by an arrangement of the bandwidth matching layer 200 is not significant. When the dielectric constant Dk of the bandwidth matching layer 200 is greater than 5, the millimeter-wave signal in the target frequency band which is the band N261 has a relatively large impedance bandwidth and a relatively high radiation efficiency. When the thickness of the bandwidth matching layer 200 falls within a range from 0.5 mm to 1.2 mm, a value of the dielectric constant Dk of the bandwidth matching layer 200 is greater than 5 and less than 11, and thus the millimeter-wave signal has a relatively large impedance bandwidth and a relatively high radiation efficiency. As a result, when the thickness of the bandwidth matching layer 200 falls within a range from 0.5 mm to 1.2 mm and the dielectric constant Dk of the bandwidth matching layer 200 is greater than 5 and less than 11, coexistence of a relatively large impedance bandwidth and a relatively high radiation efficiency of the millimeter wave signal in the target frequency band which is the band N261 can be achieved.

Figure 8:
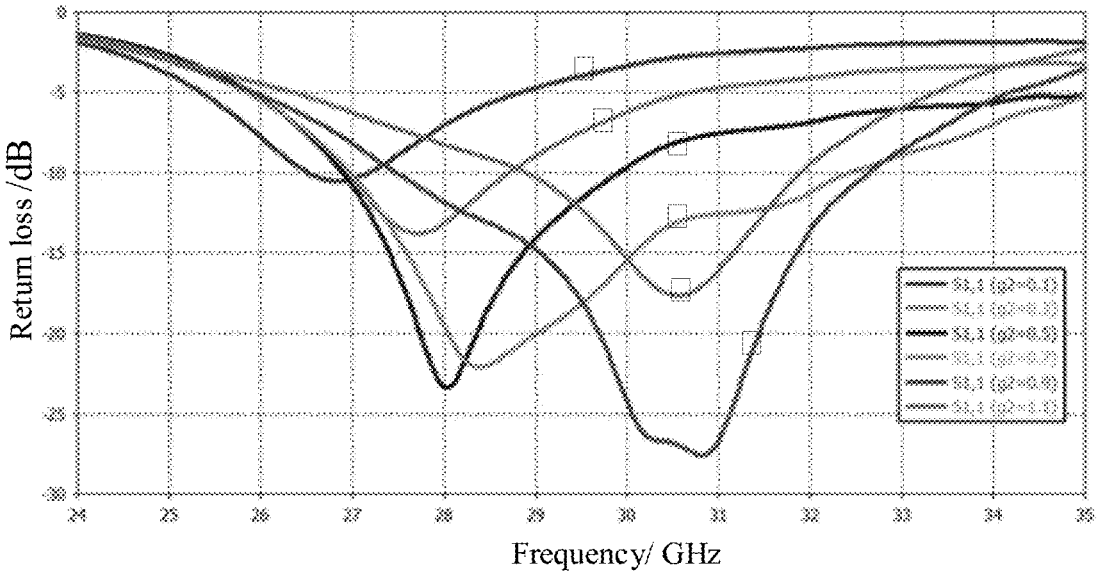
FIG. 8 illustrates a simulation graph of impedance bandwidths of millimeter wave signals in the band N261 corresponding to different distances between a surface of a bandwidth matching layer close to the antenna module and a surface of an antenna module close to the bandwidth matching layer.
Figure 9:
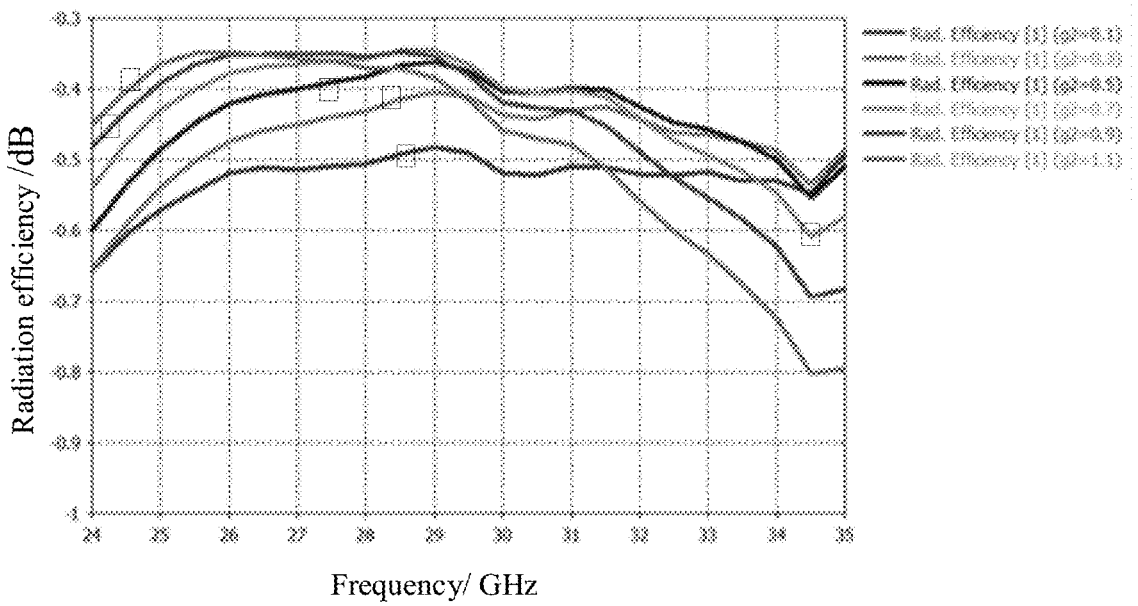
FIG. 9 illustrates a simulation graph of radiation efficiencies of millimeter wave signals in the band N261 corresponding to different distances between a surface of a bandwidth matching layer close to the antenna module and a surface of an antenna module close to the bandwidth matching layer.

Further, a distance g2 between the bandwidth matching layer 200 and the antenna module 100 is smaller than a quarter of the wavelength of the millimeter wave signal in the target frequency band. That is, the distance g2 is larger than zero and smaller than $\lambda/4$. In another implementation, the distance g2 between the bandwidth matching layer 200 and the antenna module 100 is smaller than one-tenth of the wavelength of the millimeter wave signal in the target frequency band, that is, the distance g2 is larger than zero and smaller than $\lambda/10$. Considering a thickness of an overall electronic device 1 (such as a mobile phone) provided with the antenna assembly 10, the distance g2 between the bandwidth matching layer 200 and the antenna module 100 is designed to be in a range from 0.3 mm to 1.2 mm when the target frequency band of the millimeter wave signal is the band N261. FIG. 8 illustrates a simulation graph of impedance bandwidths of millimeter wave signals in the band N261 corresponding to different distances between a surface of the bandwidth matching layer 200 close to the antenna module 100 and a surface of the antenna module 100 close to the bandwidth matching layer 200. FIG. 9 illustrates a simulation graph of radiation efficiencies of millimeter wave signals in the band N261 corresponding to different distances between the surface of the bandwidth matching layer 200 close to the antenna module 100 and the surface of the antenna module 100 close to the bandwidth matching layer 200. The distance between the surface of the bandwidth matching layer 200 close to the antenna module 100 and the surface of the bandwidth matching layer 200 close to the antenna module 100 is denoted as g2. In FIG. 8, the horizontal axis represents the frequency of the millimeter wave signal in units of GHz, and the vertical axis represents the return loss in units of dB. In FIG. 8, a curve ① is a simulation curve of the return loss S11 of the millimeter wave signal when g2 is equal to 0.1 mm. A curve ② is a simulation curve of the return loss S11 of the millimeter wave signal when g2 is equal to 0.3 mm. A curve ③ is a simulation curve of the return loss S11 of the millimeter wave signal when g2 is equal to 0.5 mm. A curve ④ is a simulation curve of the return loss S11 of the millimeter wave signal when g2 is equal to 0.7 mm. A curve ⑤ is a simulation curve of the return loss S11 of the millimeter wave signal when g2 is equal to 0.9 mm. A curve ⑥ is a simulation curve of the return loss S11 of the millimeter wave signal when g2 is equal to 1.1 mm. As can be seen in FIG. 8 and FIG. 9, the larger g2 is, the higher the radiation efficiency of the low-frequency millimeter wave signal is. When g2 is equal to 0.9 mm, the impedance bandwidth of the millimeter wave signal is 5.16 GHz for S11≤−10 dB, and the fractional bandwidth is 17.2%. That is, the fractional bandwidth of the millimeter-wave signal when the bandwidth matching layer 200 is provided is nearly 3.55 times the fractional bandwidth of the millimeter-wave signal in the free space when the bandwidth matching layer 200 is absent. In order to achieve coexistence of a relatively large impedance bandwidth and a relatively high radiation efficiency of the millimeter wave signal in the target frequency band which is the band N261, g2 is set to fall within a range from 0.3 mm to 1.2 mm. When g2 falls within the range from 0.3 mm to 1.2 mm, the millimeter wave signal in the target frequency band which is the band N261 has a relatively large impedance bandwidth and a relatively high radiation efficiency.

Figure 10:
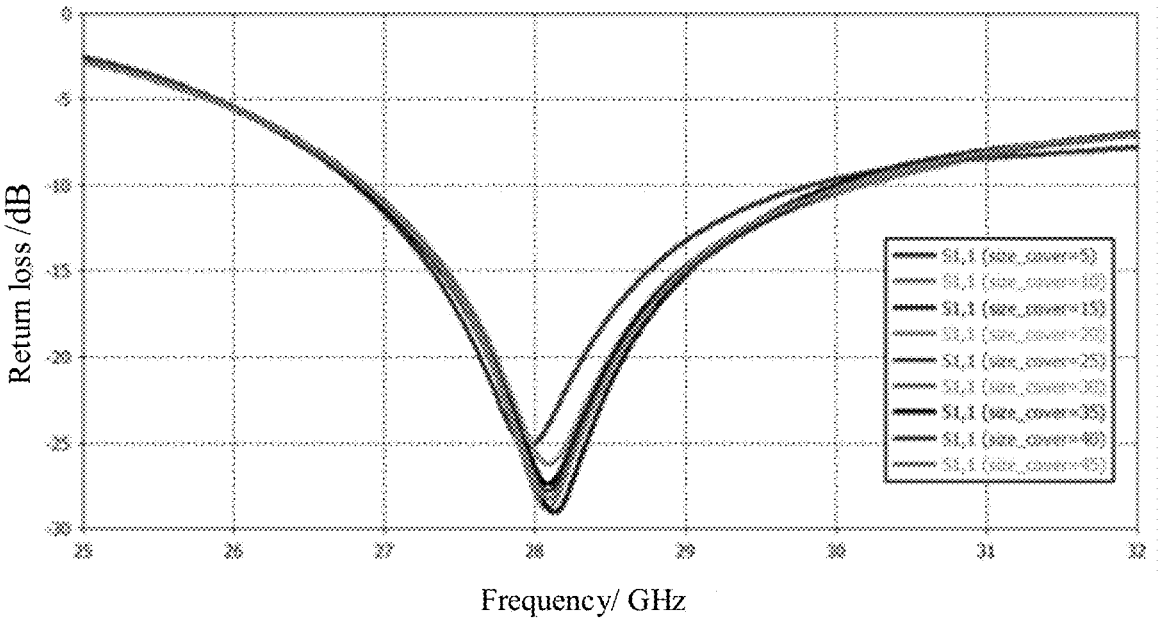
FIG. 10 illustrates a simulation graph of impedance bandwidths of millimeter wave signals in the band N261 corresponding to bandwidth matching layers of different sizes.

FIG. 10 illustrates a simulation graph of impedance bandwidths of millimeter wave signals in the band N261 corresponding to bandwidth matching layers of different sizes. The bandwidth matching layer 200 has a size in millimeters and is denoted as size_cover. In FIG. 10, the horizontal axis represents the frequency of the millimeter wave signal in units of GHz, and the vertical axis represents the return loss in units of dB. As can been seen in FIG. 10, when the bandwidth matching layer 200 is fully within the preset direction range, a variation in the size of the bandwidth matching layer 200 has no significant effect on the impedance bandwidth of the millimeter wave signal. In an implementation, a size of a part of the bandwidth matching layer 200 within the preset direction range may be larger than the wavelength of the millimeter wave signal in the target frequency band by half the wavelength of the millimeter wave signal.

Figure 11:
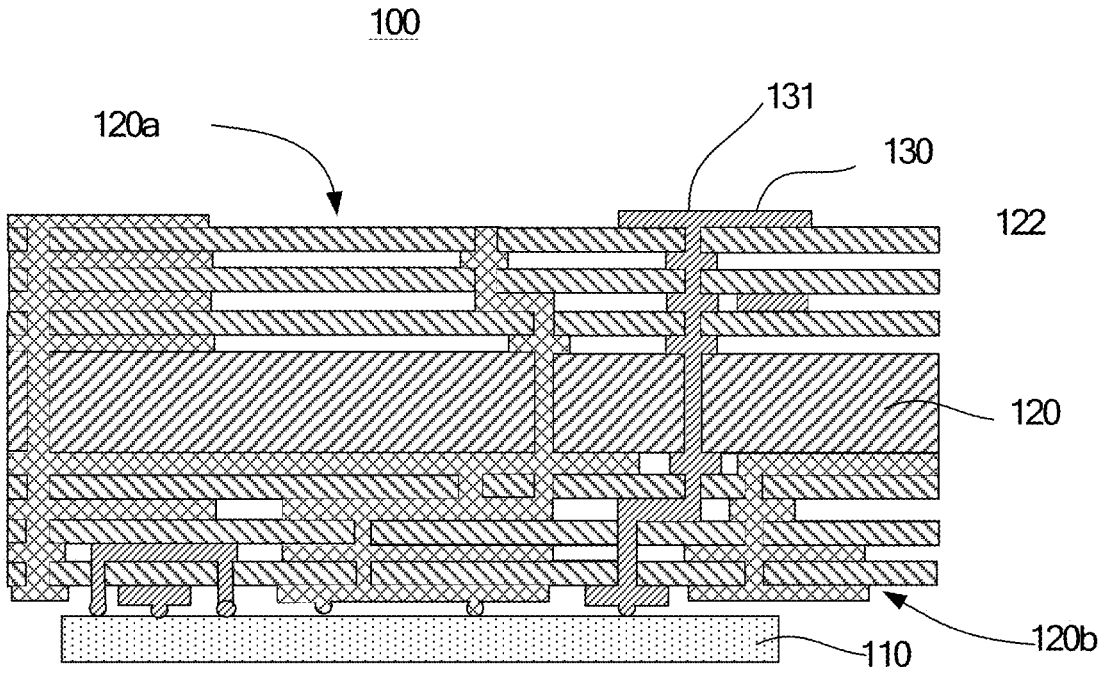
FIG. 11 is a schematic cross-sectional view of an antenna module according to an implementation of the present disclosure.

Further, FIG. 11 is a schematic cross-sectional view of the antenna module 100 according to an implementation of the present disclosure. The antenna module 100 includes a radio frequency chip 110, a dielectric substrate 120, and at least one first antenna radiator 130. The radio frequency chip 110 is configured to generate an excitation signal (also referred to as a radio frequency signal). The radio frequency chip 110 is further away from the bandwidth matching layer 200 than the at least one first antenna radiator 130. The dielectric substrate 120 carries the at least one first antenna radiator 130. The radio frequency chip 110 is electrically coupled with the at least one first antenna radiator 130 via transmission lines embedded in the dielectric substrate 120. In an implementation, the dielectric substrate 120 includes a first surface 120*a* and a second surface 120*b* opposite the first surface 120*a*. The dielectric substrate 120 is used to carry the at least one first antenna radiator 130. In the implementation, the at least one first antenna radiator 130 is on the first surface 120*a*. Alternatively, the at least one first antenna radiator 130 is embedded in the dielectric substrate 120. As an example, in FIG. 11, the at least one first antenna radiator 130 is disposed on the first surface 120*a*, and the radio frequency chip 110 is disposed on the second surface 120*b*. The excitation signal generated by the radio frequency chip 110 is transmitted to the at least one first antenna radiator 130 via the transmission lines embedded in the dielectric substrate 120. The radio frequency chip 110 may be soldered on the dielectric substrate 120 such that the excitation signal is transmitted to each first antenna radiator 130 via the transmission lines embedded in the dielectric substrate 120. Each first antenna radiator 130 receives the excitation signal and generates a millimeter wave signal according to the excitation signal. Each first antenna radiator 130 may be, but is not limited to, a patch antenna.

Further, a minimum distance between the first surface 120*a* and the bandwidth matching layer 200 is smaller than a minimum distance between the second surface 120*b* and the bandwidth matching layer 200. An orthographic projection of the bandwidth matching layer 200 on the antenna module 100 and the at least one first antenna radiator 130 at least partially overlap. Further, the radio frequency chip 110 is further away from the bandwidth matching layer 200 than the at least one first antenna radiator 130. An output terminal of the radio frequency chip 110 used to output the excitation signal is disposed at a side of the dielectric substrate 120 away from the bandwidth matching layer 200. That is, the radio frequency chip 110 is disposed close to the second surface 120*b* of the dielectric substrate 120 and away from the first surface 120*a* of the dielectric substrate 120.

Further, each first antenna radiator 130 includes at least one feeding point 131. Each feeding point 131 is electrically coupled with the radio frequency chip 110 via the transmission lines. For each feeding point 131 of each first antenna radiator 130, a distance between the feeding point 131 and a center of the first antenna radiator 130 is larger than a preset distance. An adjustment of a position of the feeding point 131 can change an input impedance of the first antenna radiator 130. In this implementation, for each feeding point 131 of each first antenna radiator 130, by setting the distance between the feeding point 131 and the center of the first antenna radiator 130 to be larger than the preset distance, the input impedance of the first antenna radiator 130 is adjusted. The input impedance of the first antenna radiator 130 is adjusted to enable the input impedance of the first antenna radiator 130 to match an output impedance of the radio frequency chip 110. When the input impedance of the first antenna radiator 130 matches the output impedance of the radio frequency chip 110, a reflection amount of the excitation signal generated by the radio frequency signal is minimal. Further, according to the present disclosure, the bandwidth matching layer 200 is provided to match the impedance of the antenna module 100 to the impedance of the free space and the input impedance of the first antenna radiator 130 corresponding to the feeding point 131 is adjusted, such that the antenna assembly 10 is enabled to have a relatively large bandwidth. A process of adjusting the antenna assembly 10 includes the following. The antenna module 100 of the antenna assembly 10 is disposed in the free space. The bandwidth matching layer 200 is then disposed, where the bandwidth matching layer 200 is spaced apart from the antenna module 100 and partially within the preset direction range. The position of the feeding point 131 is adjusted to adjust the input impedance of the first antenna radiator 130.

Figure 12:
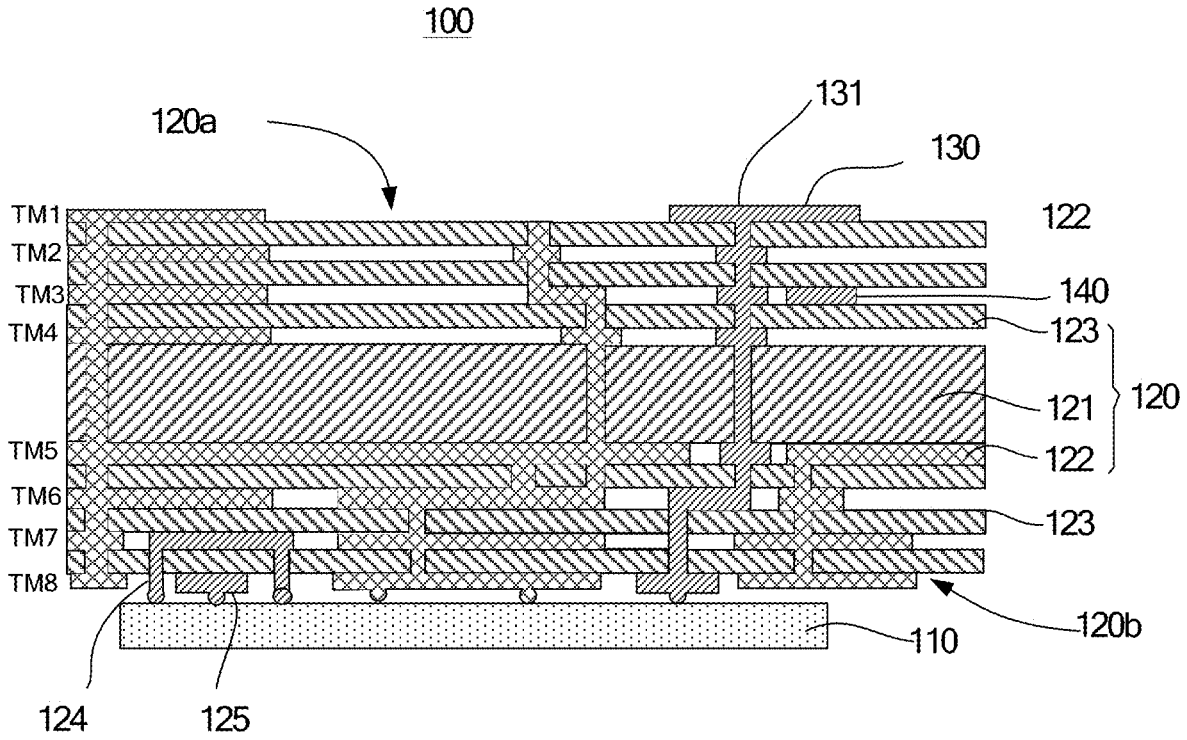
FIG. 12 is a schematic cross-sectional view of an antenna module according to another implementation of the present disclosure.

FIG. 12 is a schematic cross-sectional view of the antenna module 100 according to another implementation of the present disclosure. The antenna module 100 provided in this implementation is substantially the same as the antenna module 100 provided in FIG. 11 and the related description of FIG. 11, except that the antenna module 100 in this implementation further includes at least one second antenna radiator 140. That is, in this implementation, the antenna module 100 includes the radio frequency chip 110, the dielectric substrate 120, the at least one first antenna radiator 130, and the at least one second antenna radiator 140. The radio frequency chip 110 is configured to generate the excitation signal. The dielectric substrate 120 includes the first surface 120*a* and the second surface 120*b* opposite the first surface 120*a*. The at least one first antenna radiator 130 is disposed on the first surface 120*a*, and the radio frequency chip 110 is disposed on the second surface 120*b*. The excitation signal generated by the radio frequency chip 110 is transmitted to the at least one first antenna radiator 130 via the transmission lines embedded in the dielectric substrate 120. The radio frequency chip 110 can be soldered on the dielectric substrate 120 such that the excitation signal is transmitted to each first antenna radiator 130 via the transmission lines embedded in the dielectric substrate 120. Each first antenna radiator 130 receives the excitation signal and generates a millimeter wave signal according to the excitation signal. Further, the minimum distance between the first surface 120*a* and the bandwidth matching layer 200 is smaller than the minimum distance between the second surface 120*b* and the bandwidth matching layer 200. The orthographic projection of the bandwidth matching layer 200 on the antenna module 100 and the at least one first antenna radiator 130 at least partially overlap.

Further, the radio frequency chip 110 is further away from the bandwidth matching layer 200 than the at least one first antenna radiator 130. The output terminal of the radio frequency chip 110 used to output the excitation signal is disposed at the side of the dielectric substrate 120 away from the bandwidth matching layer 200.

Further, each first antenna radiator 130 includes the at least one feeding point 131. Each feeding point 131 is electrically coupled with the radio frequency chip 110 via the transmission lines. For each feeding point 131 of each first antenna radiator 130, the distance between the feeding point 131 and the center of the first antenna radiator 130 is smaller than the preset distance.

In this implementation, the at least one second antenna radiator 140 is embedded in the dielectric substrate 120. The at least one second antenna radiator 140 is spaced apart from the at least one first antenna radiator 130, and the at least one second antenna radiator 140 is coupled with the at least one first antenna radiator 130 to form a stacked patch antenna. When the at least one second antenna radiator 140 is coupled with the at least one first antenna radiator 130 to form the stacked patch antenna, the at least one first antenna radiator 130 is electrically connected with the radio frequency chip 110, while the at least one second antenna radiator 140 is not electrically connected with the radio frequency chip 110. The at least one second antenna radiator 140 couples with the millimeter wave signal radiated by the at least one first antenna radiator 130 and generates a new millimeter wave signal according to the millimeter wave signal radiated by the at least one first antenna radiator 130, where the at least one second antenna radiator 140 is coupled with the at least one first antenna radiator 130.

In an implementation, an example that the antenna module 100 is manufactured through the HDI process is given below for description. The dielectric substrate 120 includes a core layer 121 and multiple wiring layers 122 stacked on opposite sides of the core layer 121. The core layer 121 is an insulating layer, and each wiring layer 122 is usually directly provided with an insulating layer 123. The insulating layer 123 can also be called a prepreg (PP) layer. The wiring layer 122 disposed at a side of the core layer 121 close to the bandwidth matching layer 200 and furthest away from the core layer 121 has an outer surface forming at least part of the first surface 120*a* of the dielectric substrate 120. The wiring layer 122 disposed at a side of the core layer 121 away from the bandwidth matching layer 200 and furthest away from the core layer 121 has an outer surface forming the second surface 120*b* of the dielectric substrate 120. The at least one first antenna radiator 130 is disposed on the first surface 120*a*. The at least one second antenna radiator 140 is embedded in the dielectric substrate 120. That is, the at least one second antenna radiator 140 can be disposed on other wiring layers 122 which are used for arranging antenna radiators, and the at least one second antenna radiator 140 is not disposed on a surface of the dielectric substrate 120.

Further, in an implementation of the present disclosure, by providing the antenna assembly 10 with the bandwidth matching layer 200 spaced apart from the antenna module 100, the bandwidth matching layer 200 can match the impedance of the antenna module 100 to the impedance of the free space, such that the impedance bandwidth of the antenna module 100 in the target frequency band when the bandwidth matching layer 200 is provided is greater than the impedance bandwidth of the antenna module 100 in the free space. Compared with a conventional antenna module manufactured only through the HDI process, i.e., without usage of the bandwidth matching layer 200, the antenna module 100 of the present disclosure may be designed to be relatively thin, thereby facilitating the lightness and thinness of the antenna module 100.

In this implementation, an example that the dielectric substrate 120 with an eight-layer structure is given below for illustration. It is noted that, in other implementations, the number of layers of the dielectric substrate 120 may be other. The dielectric substrate 120 includes the core layer 121, a first wiring layer TM1, a second wiring layer TM2, a third wiring layer TM3, a fourth wiring layer TM4, a fifth wiring layer TM5, a sixth wiring layer TM6, and a seventh wiring layer TM7, and an eighth wiring layer TM8. The first wiring layer TM1, the second wiring layer TM2, the third wiring layer TM3, and the fourth wiring layer TM4 are sequentially stacked on the same surface of the core layer 121. Alternatively, the first wiring layer TM1, the second wiring layer TM2, the third wiring layer TM3, and the fourth wiring layer TM4 are sequentially stacked, and the fourth wiring layer TM4 is disposed on a surface of the core layer 121 away from the radio frequency chip 110. The first wiring layer TM1 is disposed further away from the core layer 121 than the fourth wiring layer TM4. A surface of the first wiring layer TM1 away from the core layer 121 forms at least a part of the first surface 120*a* of the dielectric substrate 120. The fifth wiring layer TM5, the sixth wiring layer TM6, the seventh wiring layer TM7, and the eighth wiring layer TM8 are sequentially stacked on the same surface of the core layer 121. Alternatively, the fifth wiring layer TM5, the sixth wiring layer TM6, the seventh wiring layer TM7, and the eighth wiring layer TM8 are sequentially stacked, and the fifth wiring layer TM5 is disposed on a surface of the core layer 121 close to the radio frequency chip 110. The eighth wiring layer TM8 is disposed further away from the core layer 121 than the fifth wiring layer TM5. A surface of the eighth wiring layer TM8 away from the core layer 121 is the second surface 120*b* of the dielectric substrate 120. Normally, the first wiring layer TM1, the second wiring layer TM2, the third wiring layer TM3, and the fourth wiring layer TM4 form wiring layers 122 that can be provided with the antenna radiators. The fifth wiring layer TM5 is a ground layer in which a ground electrode is provided. The sixth wiring layer TM6, the seventh wiring layer TM7, and the eighth wiring layer TM8 form wiring layers on which a feeding network and control lines of the antenna module 100 are provided. In another implementation, the sixth wiring layer TM6 and the seventh wiring layer TM7 form wiring layers on which the feeding network and the control lines of the antenna module 100 are provided. The radio frequency chip 110 is soldered on the eighth wiring layer TM8. In this implementation, the at least one first antenna radiator 130 is disposed on the surface of the first wiring layer TM1 away from the core layer 121 (alternatively, the at least one second antenna radiator 140 is disposed on the first surface 120*a*), and the at least one second antenna radiator 140 is disposed in the third wiring layer TM3. As an example, as illustrated in FIG. 12, the at least one first antenna radiator 130 is disposed on the surface of the first wiring layer TM1 and the at least one second antenna radiator 140 is disposed in the third wiring layer TM3. It is noted that, in other implementations, the at least one first antenna radiator 130 may be disposed on the surface of the first wiring layer TM1 away from the core layer 121, and the at least one second antenna radiator 140 may be disposed in the second wiring layer TM2 or the fourth wiring layer TM4.

Further, the first wiring layer TM1, the second wiring layer TM2, the third wiring layer 122, the third wiring layer TM3, the fourth wiring layer TM4, the sixth wiring layer TM6, and the seventh wiring layer TM7, and the eighth wiring layer TM8 in the dielectric substrate 120 are all electrically connected to the fifth wiring layer TM5 which is the ground layer. In an implementation, the first wiring layer TM1, the second wiring layer TM2, the third wiring layer TM3, the fourth wiring layer TM4, the sixth wiring layer TM6, and the seventh wiring layer TM7, and the eighth wiring layer TM8 in the dielectric substrate 120 all define through holes, and each through hole is filled with a metal material electrically coupled with the ground layer, such that components in each wiring layer 122 is grounded.

Further, the seventh wiring layer TM7 and the eighth wiring layer TM8 are further provided with power lines 124 and control lines 125. The power lines 124 and the control lines 125 are electrically coupled with the radio frequency chip 110 respectively. The power lines 124 are used to provide the radio frequency chip 110 with required power, and the control lines 125 are used to transmit control signals to the radio frequency chip 110 to control the operation of the radio frequency chip 110.

Figure 13:
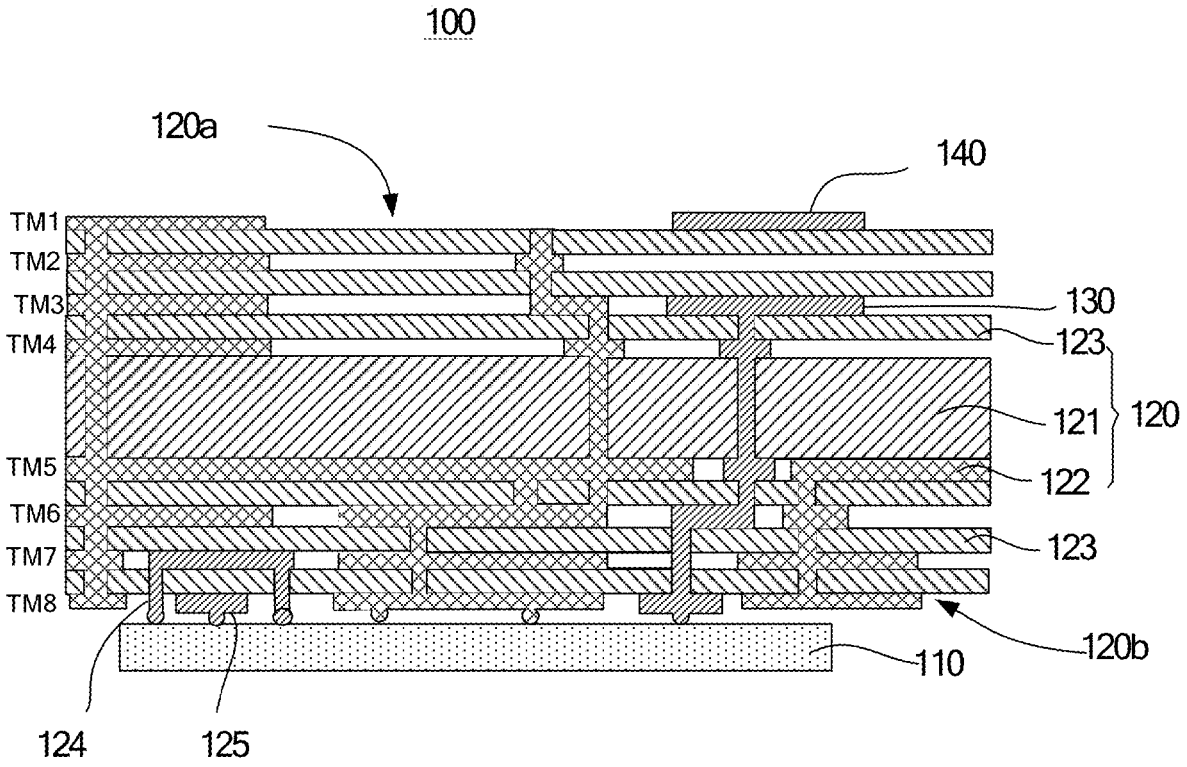
FIG. 13 is a schematic cross-sectional view of an antenna module according to yet another implementation of the present disclosure.

FIG. 13 is a schematic cross-sectional view of the antenna module 100 according to yet another implementation of the present disclosure. The antenna module 100 provided in this implementation is substantially the same as the antenna module 100 provided in FIG. 12 and the related description of FIG. 12. In this implementation, the antenna module 100 includes the radio frequency chip 110, the dielectric substrate 120, the at least one first antenna radiator 130, and the at least one second antenna radiator 140. The radio frequency chip 110 is configured to generate an excitation signal. The dielectric substrate 120 includes the first surface 120*a* and the second surface 120*b* opposite the first surface 120*a*. The at least one first antenna radiator 130 is embedded within the dielectric substrate 120. The excitation signal generated by the radio frequency chip 110 is transmitted to the at least one first antenna radiator 130 via the transmission lines embedded in the dielectric substrate 120. The radio frequency chip 110 can be soldered on the dielectric substrate 120 such that the excitation signal is transmitted to each first antenna radiator 130 via the transmission lines embedded in the dielectric substrate 120. Each first antenna radiator 130 receives the excitation signal and generates a millimeter wave signal according to the excitation signal. Further, the minimum distance between the first surface 120*a* and the bandwidth matching layer 200 is smaller than the minimum distance between the second surface 120*b* and the bandwidth matching layer 200. The orthographic projection of the bandwidth matching layer 200 on the antenna module 100 and the at least one first antenna radiator 130 at least partially overlap.

Further, the radio frequency chip 110 is further away from the bandwidth matching layer 200 than the at least one first antenna radiator 130. The output terminal of the radio frequency chip 110 used to output the excitation signal is disposed at the side of the dielectric substrate 120 away from the bandwidth matching layer 200.

Further, each first antenna radiator 130 includes the at least one feeding point 131. Each feeding point 131 is electrically coupled with the radio frequency chip 110 via the transmission lines. For each feeding point 131 of each first antenna radiator 130, the distance between the feeding point 131 and the center of the first antenna radiator 130 is larger than the preset distance. In this implementation, the feeding point 131 on the first antenna radiator 130 is disposed away from the center of the first antenna radiator 130, thereby increasing a standing wave depth of the millimeter wave signal generated by the antenna assembly 10.

Further, the at least one second antenna radiator 140 is further away from the radio frequency chip 110 than the at least one first antenna radiator 130, the at least one second antenna radiator 140 is spaced apart from the at least one first antenna radiator 130, and the at least one second antenna radiator 140 is coupled with the at least one first antenna radiator 130 to form a stacked patch antenna. When the at least one second antenna radiator 140 is coupled with the at least one first antenna radiator 130 to form the stacked patch antenna, the at least one first antenna radiator 130 is electrically connected with the radio frequency chip 110, while the at least one second antenna radiator 140 is not electrically connected with the radio frequency chip 110. The at least one second antenna radiator 140 couples with the millimeter wave signal radiated by the at least one first antenna radiator 130 and generates a new millimeter wave signal according to the millimeter wave signal radiated by the at least one first antenna radiator 130, where the at least one second antenna radiator 140 is coupled with the at least one first antenna radiator 130.

In an implementation, the at least one second antenna radiator 140 is disposed on the first surface 120*a* of the dielectric substrate 120, and the at least one first antenna radiator 130 is embedded in the dielectric substrate 120. In other implementations, the at least one second antenna radiator 140 and the at least one first antenna radiator 130 may be both embedded in the dielectric substrate 120, as long as the at least one second antenna radiator 140 and the at least one first antenna radiator 130 are spaced apart from each other and form a stacked patch antenna by coupling the at least one second antenna radiator 140 and the at least one first antenna radiator 130.

In an implementation, the dielectric substrate 120 includes the core layer 121 and the multiple wiring layers 122 stacked on opposite sides of the core layer 121. The core layer 121 and the wiring layer 122 are usually insulating layers. The wiring layer 122 disposed at the side of the core layer 121 close to the bandwidth matching layer 200 and furthest away from the core layer 121 has the outer surface forming the first surface 120*a* of the dielectric substrate 120. The wiring layer 122 disposed at the side of the core layer 121 away from the bandwidth matching layer 200 and furthest away from the core layer 121 has the outer surface forming the second surface 120*b* of the dielectric substrate 120. In this implementation, the at least one first antenna radiator 130 is embedded in the dielectric substrate 120, and the at least one second antenna radiator 140 is disposed on the first surface 120*a*.

In this implementation, an example that the above-mentioned dielectric substrate 120 with the eight-layer structure is given below for illustration. The at least one first antenna radiator 130 is disposed in the third wiring layer TM3, and the at least one second antenna radiator 140 is disposed on the surface of the first wiring layer TM1 away from the core layer 121 (alternatively, the at least one second antenna radiator 140 is disposed on the first surface 120*a*). The surface of the core layer 121 away from the first wiring layer TM1 forms the first surface 120*a* of the dielectric substrate 120. It is noted that, in other implementations, the number of layers of the dielectric substrate 120 may be other. It is noted that, in other implementations, the at least one second antenna radiator 140 and the at least one first antenna radiator 130 may be respectively disposed on/in any two layers of the first wiring layer TM1, the second wiring layer TM2, the third wiring layer TM3, and the fourth wiring layer TM4 in the dielectric substrate 120, as long as the following requirements can be satisfied, where the requirements include that the at least one second antenna radiator 140 is further away from the radio frequency chip 110 than the at least one first antenna radiator 130, the at least one first antenna radiator 130 receives the excitation signal generated by the radio frequency chip 110, and the at least one second antenna radiator 140 and the at least one first antenna radiator 130 are spaced apart from each other and form a stacked patch antenna together through coupling.

Further, with reference to the antenna assembly 10 described in any of the foregoing implementations, the bandwidth matching layer 200 is longer than the first antenna radiator 130 by a half of a wavelength of the millimeter wave signal in the target frequency band, and wider than the first antenna radiator 130 by the half of the wavelength of the millimeter wave signal in the target frequency band.

Figure 14:
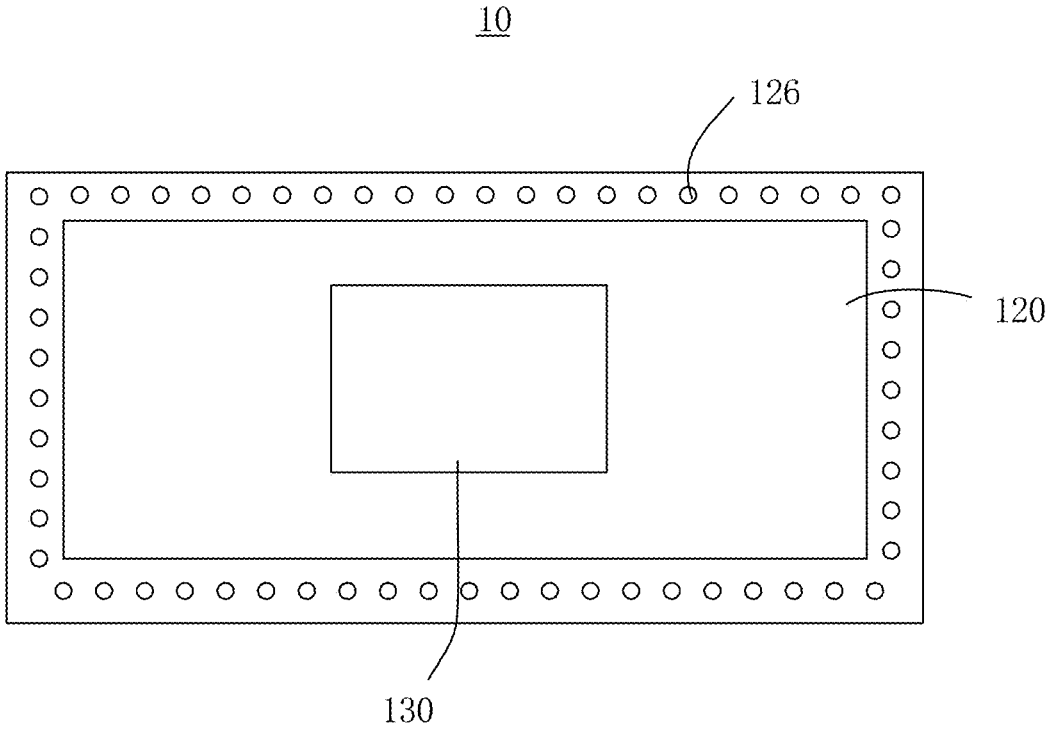
FIG. 14 is a schematic structural view of a packaged antenna module according to an implementation of the present disclosure.
Figure 15:
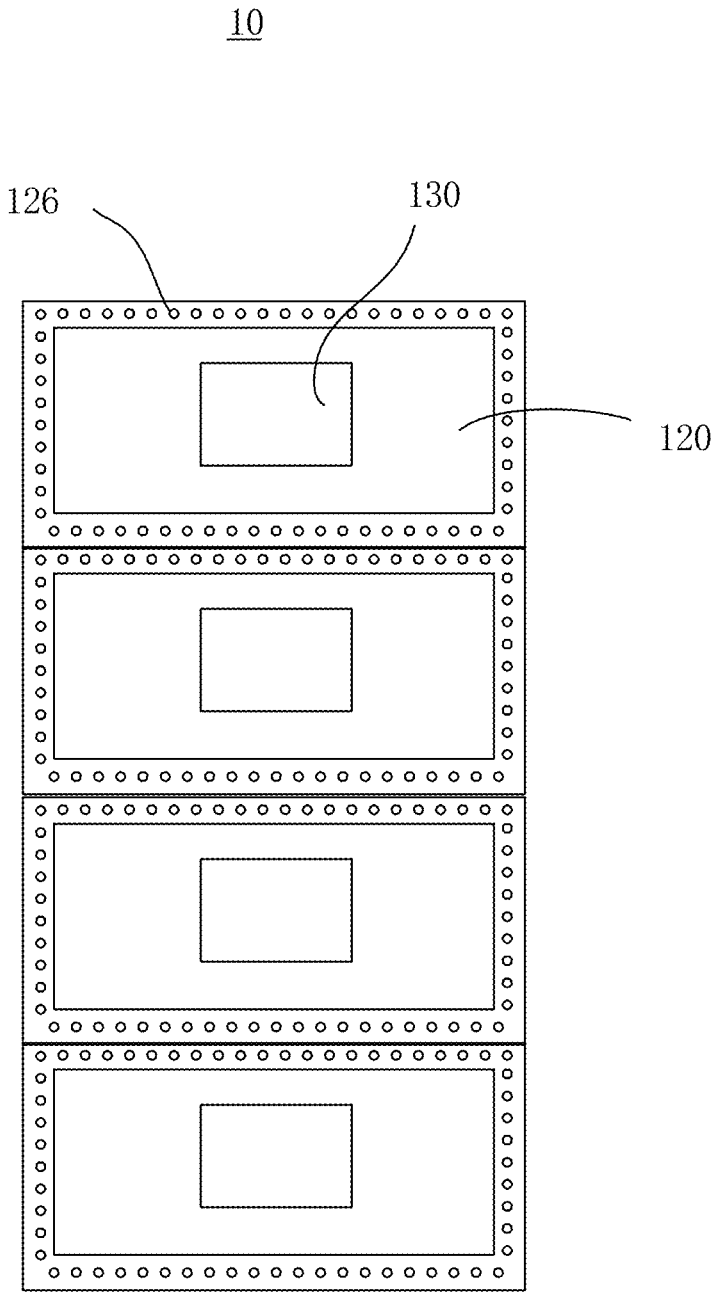
FIG. 15 is a schematic structural view of an antenna array constructed with packaged antenna modules according to an implementation of the present disclosure.

FIG. 14 is a schematic structural view of a packaged antenna module 100 according to an implementation of the present disclosure. With reference to the antenna assembly 10 described in any of the foregoing implementations, the dielectric substrate 120 further defines multiple metallized via grids 126 arranged around each first antenna radiator 130 to improve isolation between each two adjacent first antenna radiators 130. FIG. 15 is a schematic structural view of an antenna array constructed with the packaged antenna modules 100 according to an implementation of the present disclosure. When the metalized via grids 126 are defined in the multiple antenna modules 100 to achieve an antenna array, the metalized via grids 126 are used to improve the isolation between each two adjacent antenna modules 100, so as to reduce or even avoid the interference of millimeter wave signals generated by the multiple antenna modules 100.

Figure 16:
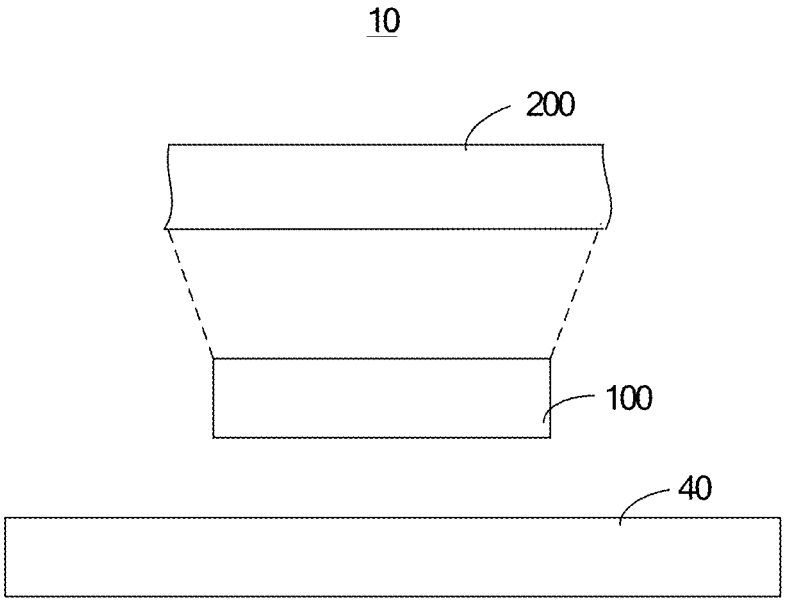
FIG. 16 is a schematic structural view of an antenna assembly according to another implementation of the present disclosure.

FIG. 16 is a schematic structural view of the antenna assembly 10 according to another implementation of the present disclosure. In this implementation, the antenna assembly 10 further includes a mainboard 40. The mainboard 40 is disposed on the side of the antenna module 100 away from the bandwidth matching layer 200. The mainboard 40 is provided with a ground electrode to prevent the millimeter wave signal in the target frequency band from being radiated toward the mainboard 40.

An example that the antenna module 100 includes a patch antenna and a stacked patch antenna is given to describe the antenna assembly 10. It is noted that the antenna module 100 may further include a dipole antenna, a magnetic electric dipole antenna, a quasi-Yagi antenna, and the like. The antenna assembly 10 may include a combination of at least one or more of a patch antenna, a stacked patch antenna, a dipole antenna, a magnetic dipole antenna, and a quasi-Yagi antenna.

It is noted that the bandwidth matching layer 200 includes one or more stacked dielectric layers. In FIG. 2, as an example, the bandwidth matching layer 200 includes one dielectric layer.

Figure 17:
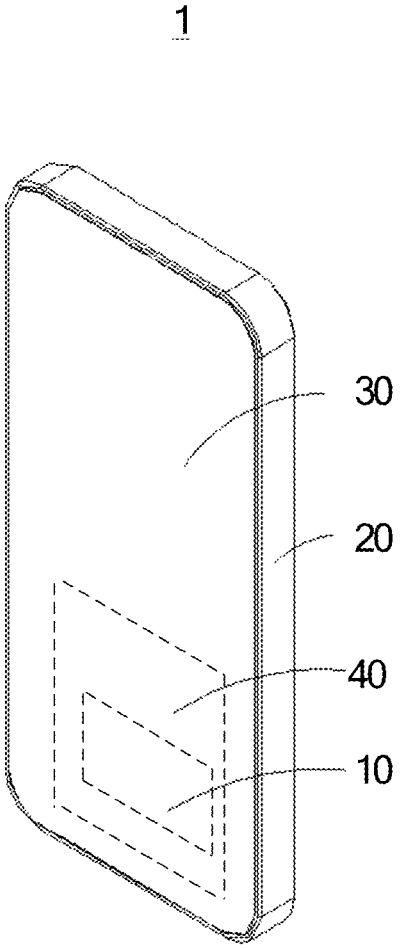
FIG. 17 is a schematic structural view of an electronic device according to an implementation of the present disclosure.

FIG. 17 is a schematic structural view of the electronic device 1 according to an implementation of the present disclosure. The electronic device 1 includes a battery cover 20 and a screen 30. The battery cover 20 and the screen 30 together define an accommodation space. The accommodation space is used to accommodate functional elements of the electronic device 1. The electronic device 1 includes the antenna assembly 10 of any of the forgoing implementations. The bandwidth matching layer 200 includes the battery cover 20 or the screen 30 of the electronic device 1. In this implementation, the antenna module 100 of the antenna assembly 10 is accommodated in the accommodation space.

Further, the electronic device 1 further includes the mainboard 40. The dielectric substrate 120 of the antenna module 100 forms a part of the mainboard 40 of the electronic device 1. The antenna module 100 is integrated in the mainboard 40 of the electronic device 1.

Further, the electronic device 1 includes a millimeter wave antenna array with M×N antenna assemblies 10, where M is a positive integer and N is a positive integer.

Figure 18:
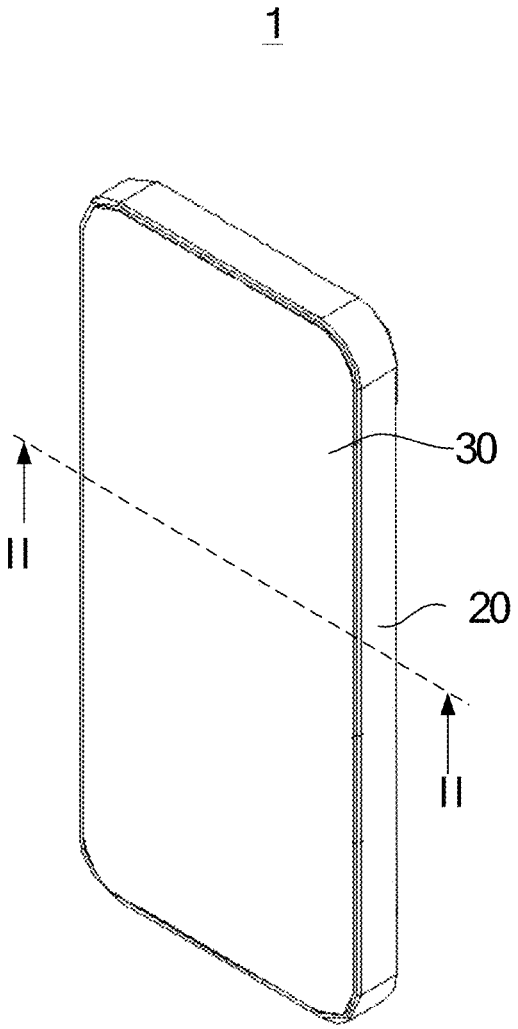
FIG. 18 is a schematic structural view of an electronic device according to another implementation of the present disclosure.
Figure 19:
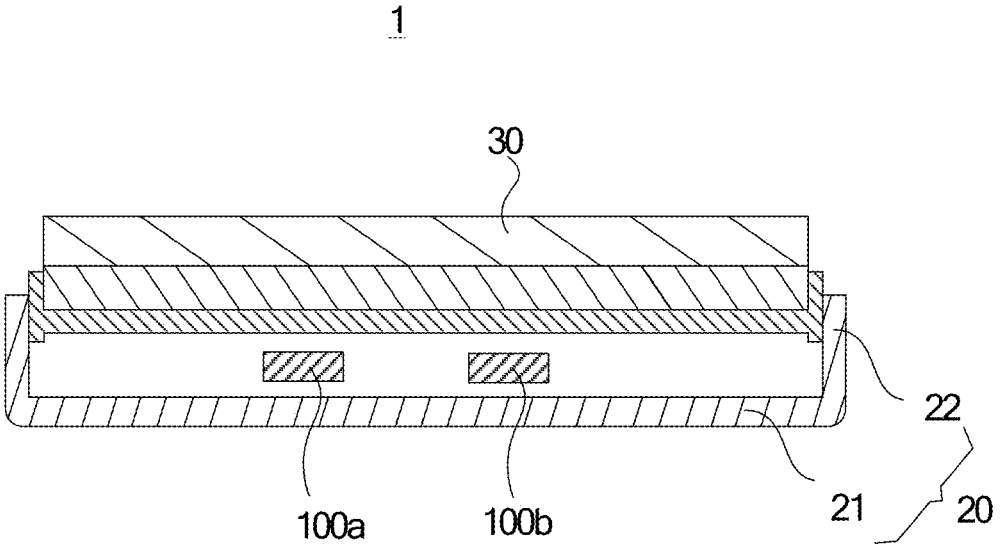
FIG. 19 is a schematic cross-sectional view of the electronic device illustrated in FIG. 18, taken along a line II-II.

FIG. 18 is a schematic structural view illustrating the electronic device 1 according to another implementation of the present disclosure. FIG. 19 is a schematic cross-sectional view of the electronic device 1 illustrated in FIG. 18, taken along a line II-II. The electronic device 1 includes a first antenna module 100*a*, a second antenna module 100*b*, and a bandwidth matching layer 200. The first antenna module 100*a* is configured to transmit and receive, within a first preset direction range, a millimeter wave signal in a first target frequency band. The second antenna module 100*b* is spaced apart from the first antenna module 100*a*, and the second antenna module 100*b* is disposed outside the first preset direction range. The second antenna module 100*b* is configured to transmit and receive, within a second preset direction range, a millimeter wave signal in a second target frequency band. The bandwidth matching layer 200 is spaced apart from the first antenna module 100*a* and the second antenna module 100*b*. The bandwidth matching layer 200 is at least partially within the first preset direction range and at least partially within the second preset direction range. The bandwidth matching layer 200 is configured to match an impedance of the first antenna module 100*a* to the impedance of the free space, such that an impedance bandwidth of the first antenna module 100*a* in the first target frequency band when the bandwidth matching layer 200 is provided is greater than an impedance bandwidth of the first antenna module 100*a* in the free space and an impedance bandwidth of the second antenna module 100*b* in the second target frequency band when the bandwidth matching layer 200 is provided is greater than an impedance bandwidth of the second antenna module 100*b* in the free space. In an implementation, the bandwidth matching layer 200 is configured to match the impedance of the first antenna module 100*a* to the impedance of the free space and match an impedance of the second antenna module 100*b* to the impedance of the free space, such that the impedance bandwidth of the first antenna module 100*a* in the first target frequency band when the bandwidth matching layer 200 is provided is greater than the impedance bandwidth of the first antenna module 100*a* in the free space and the impedance bandwidth of the second antenna module 100*b* in the second target frequency band when the bandwidth matching layer 200 is provided is greater than the impedance bandwidth of the second antenna module 100*b* in the free space.

In an implementation, a distance between the bandwidth matching layer 200 and the first antenna module 100*a* is smaller than a quarter of a wavelength of the millimeter wave signal in the first target frequency band, and a distance between the bandwidth matching layer 200 and the second antenna module 100*b* is smaller than a quarter of a wavelength of the millimeter wave signal in the second target frequency band.

Further, the bandwidth matching layer 200 includes a battery cover 20 of the electronic device 1. The battery cover 20 includes a rear plate 21 and a frame 22 bent and extending from a peripheral edge of the rear plate 21. The first antenna module 100*a* and the second antenna module 100*b* are disposed corresponding to the rear plate 21, that is, the rear plate 21 is at least partially within the first preset direction range and at least partially within the second preset direction range. The first antenna module 100*a* being disposed corresponding to the rear plate 21 means that the rear plate 21 is at least partially disposed within a range of the first antenna module 100*a*, where within the range the first antenna module 100*a* transmits and receives signals. The second antenna module 100*b* being disposed corresponding to the rear plate 21 means that the rear plate 21 is at least partially disposed within a range of the second antenna module 100*b*, where within the range the second antenna module 100*b* transmits and receives signals.

Figure 20:
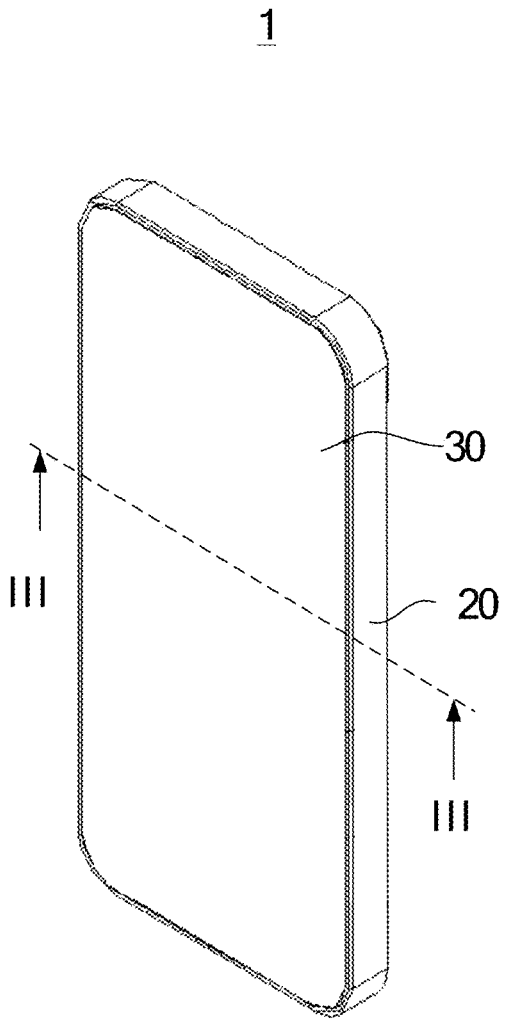
FIG. 20 is a schematic structural view of an electronic device according to another implementation of the present disclosure.
Figure 21:
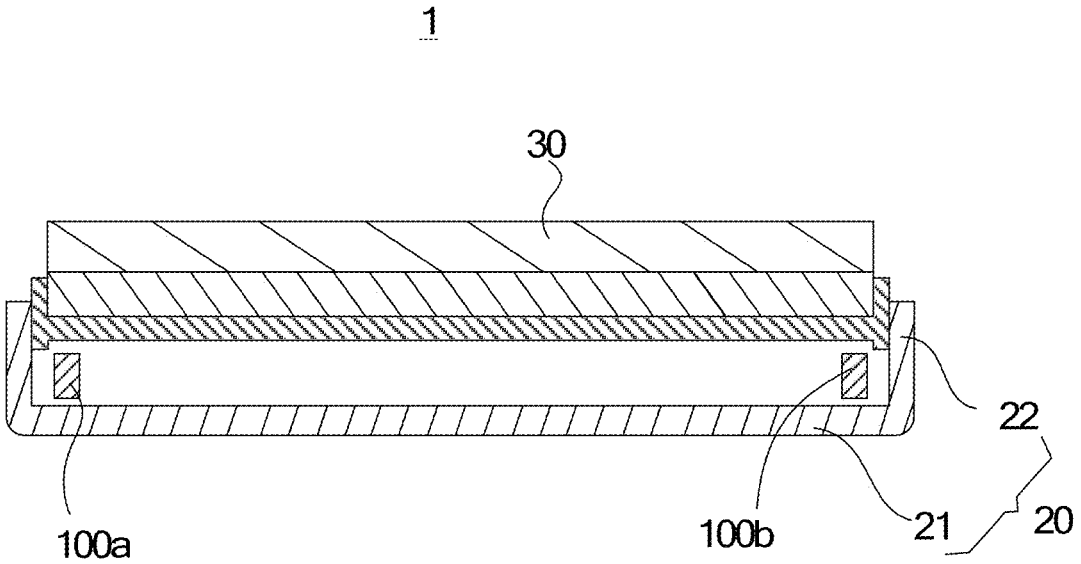
FIG. 21 is a schematic cross-sectional structural view of the electronic device illustrated in FIG. 20, taken along a line III-III.

FIG. 20 is a schematic structural view of the electronic device 1 according to another implementation of the present disclosure. FIG. 21 is a schematic cross-sectional structural view of the electronic device 1 illustrated in FIG. 20, taken along a line III-III. The electronic device 1 in this implementation is substantially the same as the electronic device 1 provided in FIG. 18 and FIG. 19 and the related description of FIG. 18 and FIG. 19, except that the first antenna module 100*a* and the second antenna module 100*b* in this implementation are disposed corresponding to the frame 22, that is, the frame 22 is at least partially within the first preset direction range and at least partially within the second preset direction range. The first antenna module 100*a* and the second antenna module 100*b* may correspond to a same part of the frame 22 of the electronic device 1. Alternatively, the first antenna module 100*a* and the second antenna module 100*b* may correspond to different parts of the frame 22 of the electronic device 1. As illustrated in FIG. 21, the first antenna module 100*a* and the second antenna module 100*b* are disposed corresponding to two opposite parts of the frame 22 of the electronic device 1, respectively. The first antenna module 100*a* being disposed corresponding to the frame 22 means that the frame 22 is at least partially disposed within a range of the first antenna module 100*a*, where within the range the first antenna module 100*a* transmits and receives signals. The second antenna module 100*b* being disposed corresponding to the frame 22 means that the frame 22 is at least partially disposed within a range of the second antenna module 100*b*, where within the range the second antenna module 100*b* transmits and receives signals.

Figure 22:
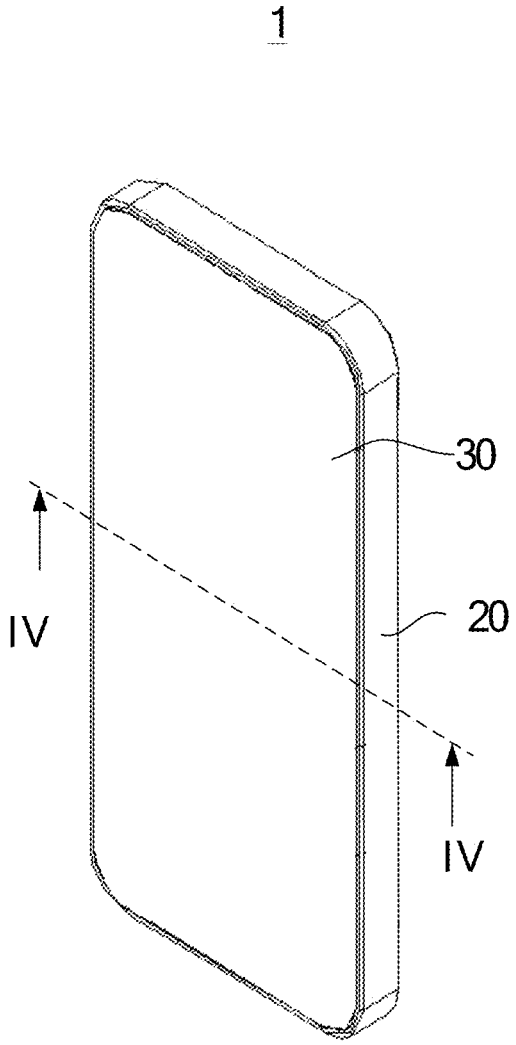
FIG. 22 is a schematic structural view of an electronic device according to another implementation of the present disclosure.
Figure 23:
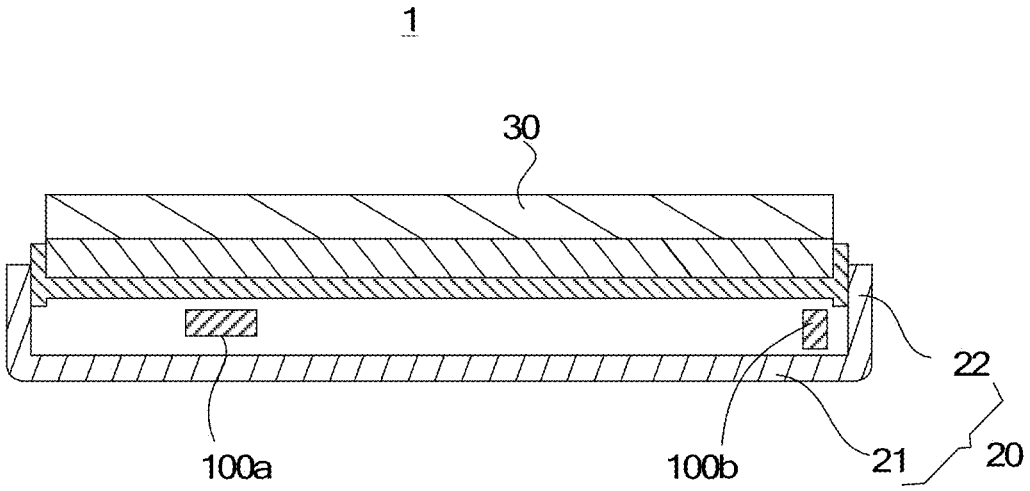
FIG. 23 is a schematic cross-sectional view of the electronic device illustrated in FIG. 22, taken along a line IV-IV.

FIG. 22 is a schematic structural view of the electronic device 1 according to another implementation of the present disclosure. FIG. 23 is a schematic cross-sectional view of the electronic device illustrated in FIG. 22, taken along a line IV-IV. The electronic device 1 in this implementation is substantially the same as the electronic device 1 provided in FIG. 18 and FIG. 19 and the related description of FIG. 18 and FIG. 19, except that the first antenna module 100*a* in this implementation is disposed corresponding to the rear plate 21 and the second antenna module 100*b* in this implementation is disposed corresponding to the frame 22, that is, the rear plate 21 is at least partially within the first preset direction range and the frame 22 is at least partially within the second preset direction range. The first antenna module 100*a* being disposed corresponding to the rear plate 21 means that the rear plate 21 is at least partially disposed within a range of the first antenna module 100*a*, where within the range the first antenna module 100*a* transmits and receives signals. The second antenna module 100*b* being disposed corresponding to the frame 22 means that the frame 22 is at least partially disposed within a range of the second antenna module 100*b*, where within the range the second antenna module 100*b* transmits and receives signals. In another implementation, the first antenna module 100*a* in this implementation is disposed corresponding to the frame 22 and the second antenna module 100*b* in this implementation is disposed corresponding to the rear plate 21, that is, the frame 22 is at least partially within the first preset direction range and the rear plate 21 is at least partially within the second preset direction range.

When the bandwidth matching layer 200 includes the battery cover 20 of the electronic device 1, in any implementation, the electronic device 1 includes the first antenna module 100*a* and the second antenna module 100*b*. A relationship between the first antenna module 100*a* and the battery cover 20 in this implementation satisfies the relationship between the antenna module 100 and the bandwidth matching layer 200 described in any of the forgoing implementations, and as for the details, reference may be made to the foregoing description, which is not described in detail herein again. Correspondingly, a relationship between the second antenna module 100*b* and the battery cover 20 in this implementation satisfies the relationship between the antenna module 100 and the bandwidth matching layer 200 described in any of the forgoing implementations, and as for the details, reference may be made to the foregoing description, which is not described in detail herein again.

Figure 24:
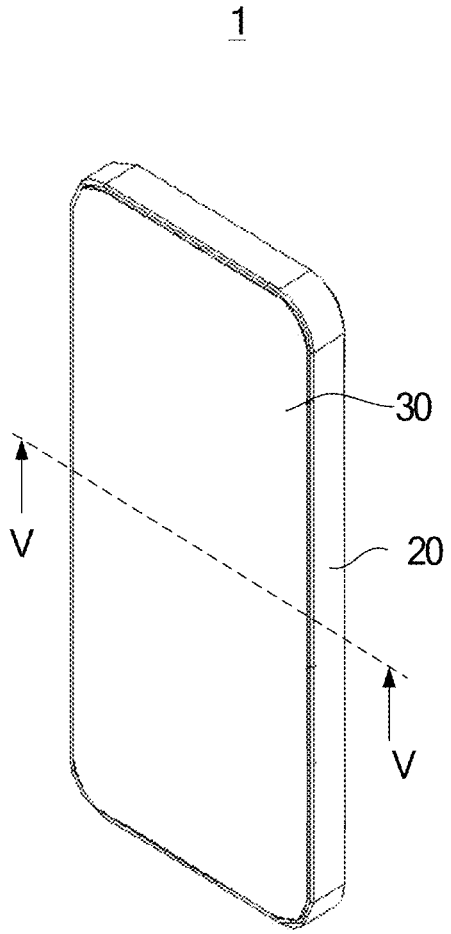
FIG. 24 is a schematic structural view of an electronic device according to another implementation of the present disclosure.
Figure 25:
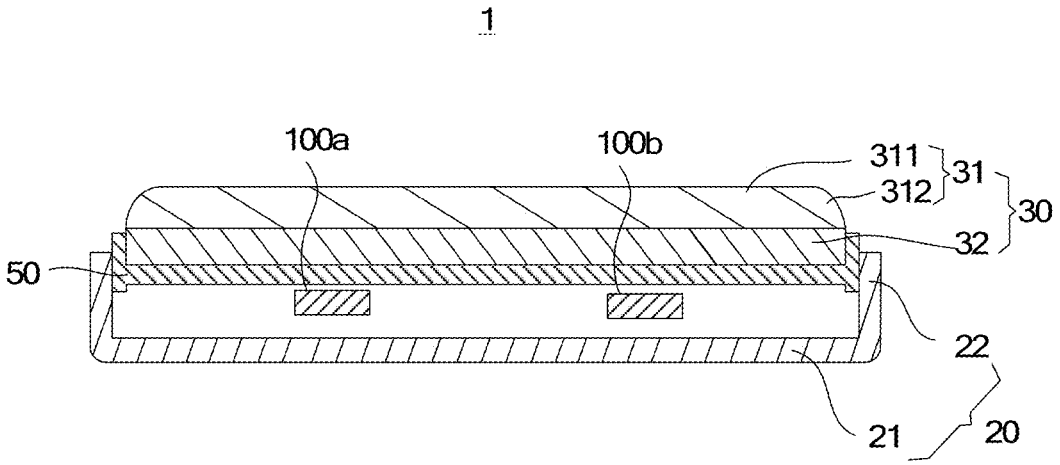
FIG. 25 is a schematic cross-sectional structural view of the electronic device illustrated in FIG. 24, taken along a line V-V.

FIG. 24 is a schematic structural view of the electronic device 1 according to another implementation of the present disclosure. FIG. 25 is a schematic cross-sectional structural view of the electronic device 1 illustrated in FIG. 24, taken along a line V-V. In this implementation, the bandwidth matching layer 200 includes a cover plate 31 of the electronic device 1. In an implementation, the screen 30 includes a display screen 32 and the cover plate 31 stacked on and covering the display screen 32. The display screen 32 is used for displaying videos, texts, images, and the like. The cover plate 31 is used for protecting the display screen 32. The cover plate 31 is a curved cover plate. The cover plate 31 includes a body portion 311 and an extending portion 312 bent and extending from a peripheral edge of the body portion 311. A surface of the body portion 311 away from the display screen 32 is a flat surface, and a surface of the extending portion 312 away from the display screen 32 is a curved surface. The surface of the body portion 311 away from the display screen 32 is connected with the surface of the extending portion 312 away from the display screen 32. For example, the cover plate 31 may be a 2.5-dimensional (2.5D) curved cover plate. In this implementation, both the first antenna module 100*a* and the second antenna module 100*b* are disposed corresponding to the body portion 311. The first antenna module 100*a* being disposed corresponding to the body portion 311 means that the body portion 311 is disposed within a range of the first antenna module 100*a*, where within the range the first antenna module 100*a* transmits and receives signals. The second antenna module 100*b* being disposed corresponding to the body portion 311 means that the body portion 311 is disposed within a range of the second antenna module 100*b*, where within the range the second antenna module 100*b* transmits and receives signals.

In this implementation, the electronic device 1 further includes a support plate 50. The support plate 50 is disposed on a side of the display screen 32 away from the cover plate 31. The support plate 50 is used to support the display screen 32.

Figure 26:
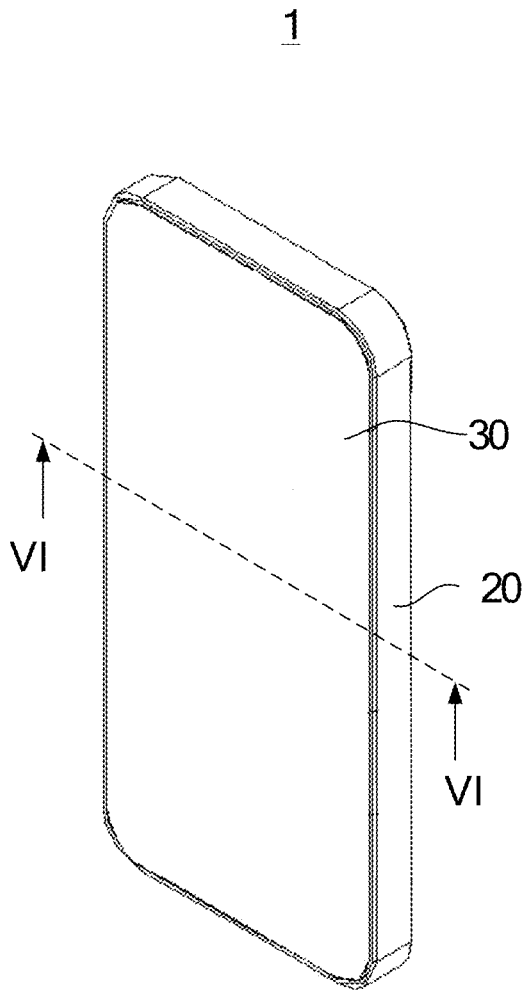
FIG. 26 is a schematic structural view of an electronic device according to another implementation of the present disclosure.
Figure 27:
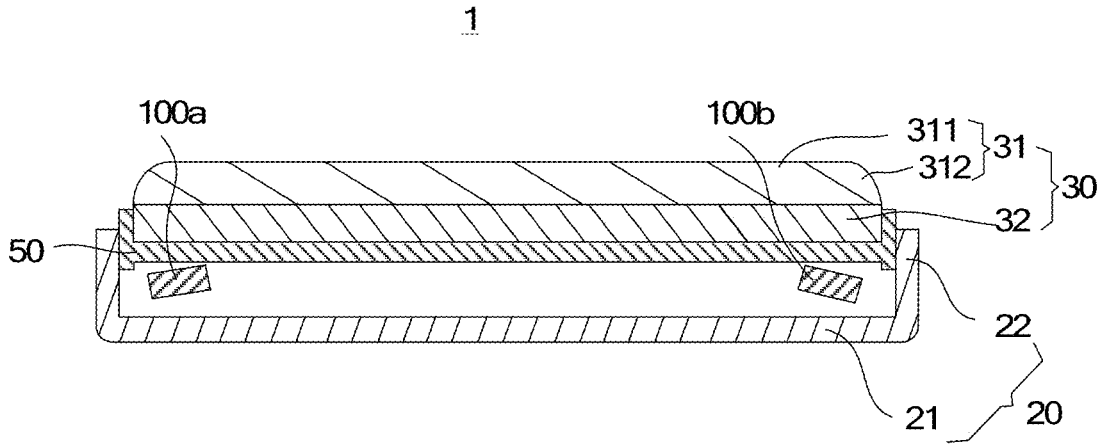
FIG. 27 is a schematic cross-sectional structural view of the electronic device illustrated in FIG. 26, taken along a line VI-VI.

FIG. 26 is a schematic structural view of the electronic device 1 according to another implementation of the present disclosure. FIG. 27 is a schematic cross-sectional structural view of the electronic device 1 illustrated in FIG. 26, taken along a line VI-VI. The electronic device 1 in this implementation is substantially the same as the electronic device 1 provided in FIG. 24 and FIG. 25 and the related description of FIG. 24 and FIG. 25, except that both the first antenna module 100*a* and the second antenna module 100*b* in this implementation are disposed corresponding to the extending portion 312, that is, the extending portion 312 is at least partially within the first preset direction range and at least partially within the second preset direction range. The first antenna module 100*a* and the second antenna module 100*b* may be disposed corresponding to the same part of the extending portion 312 of the electronic device 1. Alternatively, the first antenna module 100*a* and the second antenna module 100*b* may be disposed corresponding to different parts of the extending portion 312 of the electronic device 1. As illustrated in FIG. 27, the first antenna module 100*a* and the second antenna module 100*b* are disposed corresponding to two opposite parts of the extending portion 312 of the electronic device 1, respectively. It is noted that, the same part of the extending portion 312 described herein refers to a part extending from a side of the body portion 311, and the different parts of the extending portion 312 described herein refer to different parts extending from different sides of the body portion 311. The first antenna module 100*a* being disposed corresponding to the extending portion 312 means that the extending portion 312 is disposed within a range of the first antenna module 100*a*, where within the range the first antenna module 100*a* transmits and receives signals. The second antenna module 100*b* being disposed corresponding to the extending portion 312 means that the extending portion 312 is disposed within a range of the second antenna module 100*b*, where within the range the second antenna module 100*b* transmits and receives signals.

Figure 28:
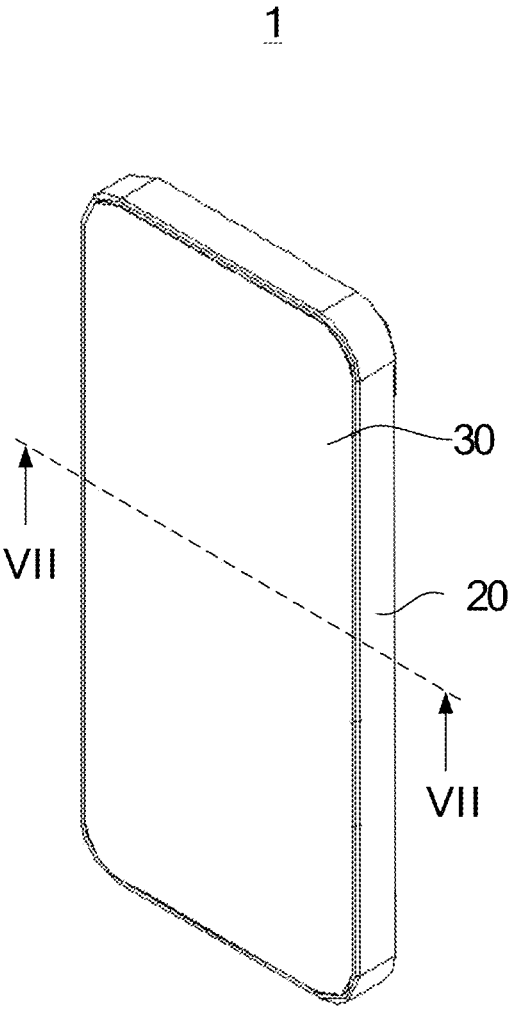
FIG. 28 is a schematic structural view of an electronic device according to another implementation of the present disclosure.
Figure 29:
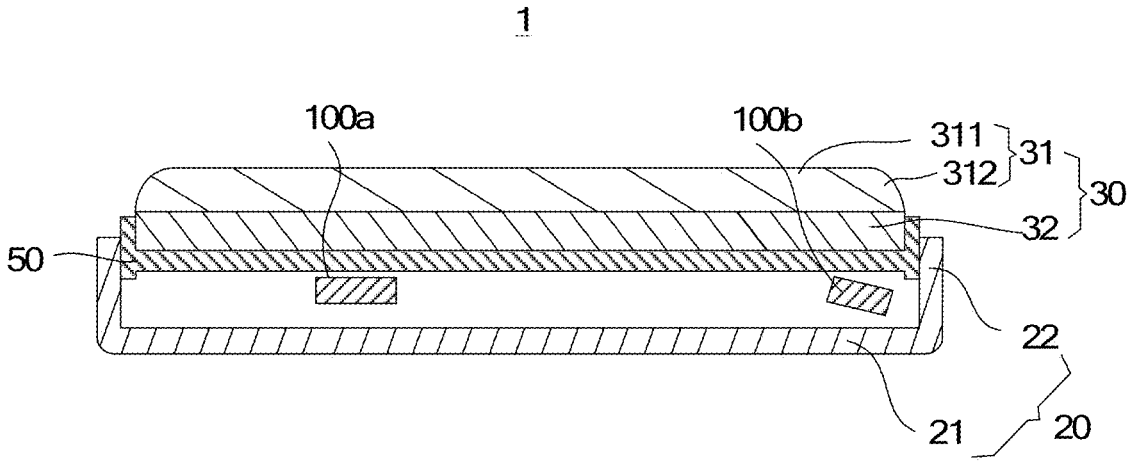
FIG. 29 is a schematic cross-sectional view of the electronic device illustrated in FIG. 28, taken along a line VII-VII.

FIG. 28 is a schematic structural view of the electronic device 1 according to another implementation of the present disclosure. FIG. 29 is a schematic cross-sectional view of the electronic device 1 illustrated in FIG. 28, taken along a line VII-VII. The electronic device 1 in this implementation is substantially the same as the electronic device 1 provided in FIG. 24 and FIG. 25 and the related description of FIG. 24 and FIG. 25, except that the first antenna module 100*a* in this implementation is disposed corresponding to the body portion 311 and the second antenna module 100*b* in this implementation is disposed corresponding to the extending portion 312, that is, the body portion 311 is at least partially within the first preset direction range and the extending portion 312 is at least partially within the second preset direction range. The first antenna module 100*a* being disposed corresponding to the body portion 311 means that the body portion 311 is disposed within a range of the first antenna module 100*a*, where within the range the first antenna module 100*a* transmits and receives signals. The second antenna module 100*b* being disposed corresponding to the extending portion 312 means that the extending portion 312 is disposed within a range of the second antenna module 100*b*, where within the range the second antenna module 100*b* transmits and receives signals.

When the bandwidth matching layer 200 includes the body portion 311 of the electronic device 1, in any implementation, the electronic device 1 includes the first antenna module 100*a* and the second antenna module 100*b*. A relationship between the first antenna module 100*a* and body portion 311 in this implementation satisfies the relationship between the antenna module 100 and the bandwidth matching layer 200 described in any of the forgoing implementations, and as for the details, reference may be made to the foregoing description, which is not described in detail herein again. Correspondingly, a relationship between the second antenna module 100*b* and the body portion 311 in this implementation satisfies the relationship between the antenna module 100 and the bandwidth matching layer 200 described in any of the forgoing implementations, and as for the details, reference may be made to the foregoing description, which is not described in detail herein again.

An example that the electronic device 1 including two antenna modules (i.e., the first antenna module 100*a* and the second antenna module 100*b*) is illustrated in FIGS. 18 to 29 and the related description of FIGS. 18 to 29. It is noted that, in other implementations, the electronic device 1 may further include multiple antenna modules 100. The antenna modules 100 are spaced apart from each other, and each of the antenna modules 100 is disposed outside preset direction ranges of other antenna modules 100, where within the preset direction ranges the other antenna modules 100 transmit and receive millimeter wave signals in target frequency bands. For each antenna module 100, the bandwidth matching layer 200 can match the impedance of the antenna module 100 to the impedance of the free space to enable the impedance bandwidth of the antenna module 100 in the target frequency band of the antenna module 100 when the bandwidth matching layer 200 is provided to be greater than the impedance bandwidth of the antenna module 100 in the free space.

It is appreciated that in the description of the implementations of the present disclosure, terms "first" and "second" are merely used for descriptive purposes, and should not be understood as indicating or implying relative importance or implicitly indicating the number of technical features indicated. Therefore, the feature defined with the term "first" or "second" may explicitly or implicitly include one or more of the features. In the description of the implementations of the present disclosure, the terms "a plurality of" and "multiple" means that that the number is two or more, unless otherwise clearly specified.

In the description of the implementations of the present disclosure, it is appreciated that terms "interconnect" and "connect" should be understood in a broad sense unless otherwise specified and limited. For example, terms "interconnect" and "connect" may refer to fixedly connect, detachably connect, or integrally connect. The terms "interconnect" and "connect" may also refer to mechanically connect, electrically connect, or communicate with each other. The terms "interconnect" and "connect" may also refer to directly connect, indirectly connect through an intermediate medium, intercommunicate interiors of two elements, or interact between two elements. For those of ordinary skill in the art, the specific meanings of the above terms in the implementations of the present disclosure can be understood according to specific situations.

The above disclosure provides many different implementations or examples for implementing different structures in the implementations of the present disclosure. To simplify the implementations of the present disclosure, the components and configurations of the specific examples are described above. Of course, they are merely examples and are not intended to limit the present disclosure. In addition, the implementations of the present disclosure may relate to repetition of reference numerals and/or reference letters in different examples, and such repetition is for the purpose of simplicity and clarity, and the repetition itself does not indicate a relationship between the various implementations and/or configurations discussed. In addition, the implementations of the present disclosure provide examples of various specific processes and materials, but those of ordinary skill in the art may be aware of the application of other processes and/or the use of other materials.

In the description of the present disclosure, descriptions with reference to terms "one implementation", "some implementations", "examples", "specific examples", or "some examples" and the like mean that specific features, structures, materials, or characteristics described in combination with the implementations or examples are included in at least one implementation or example of the present disclosure. The schematic expressions of the above terms herein do not necessarily refer to the same implementation or example. Moreover, the particular features, structures, materials, or characteristics described may be combined in any suitable manner in any one or more implementations or examples.

Although the implementations of the present disclosure have been illustrated and described above, it can be understood that the above implementations are exemplary and cannot be understood as limitations on the present disclosure. Those skilled in the art can make changes, modifications, replacements, and variations for the above implementations within the scope of the present disclosure, and these improvements and modifications are also considered to fall into the protection scope of the present disclosure.

What is claimed is:

1. An antenna assembly, comprising:

a packaged antenna module configured to transmit and receive, within a preset direction range, a millimeter wave signal in a target frequency band; and a bandwidth matching layer spaced apart from the packaged antenna module, wherein at least part of the bandwidth matching layer is disposed within the preset direction range, and the bandwidth matching layer is configured to match an impedance of the packaged antenna module to an impedance of free space to enable an impedance bandwidth of the packaged antenna module in the target frequency band when the bandwidth matching layer is provided to be greater than an impedance bandwidth of the packaged antenna module in the free space, wherein a distance between the bandwidth matching layer and the packaged antenna module is smaller than a quarter of a wavelength of the millimeter wave signal in the target frequency band.

2. The antenna assembly of claim 1, wherein a relationship between a thickness h_cover of the bandwidth matching layer and a dielectric constant Dk of the bandwidth matching layer is:

$$\frac{\lambda}{2\sqrt{Dk}} > \text{h_cover} \geq \frac{\lambda}{2\pi(Dk-1)},$$

wherein λ represents a wavelength of the millimeter wave signal in the target frequency band.

3. The antenna assembly of claim 2, wherein the dielectric constant of the bandwidth matching layer is larger than five.

4. The antenna assembly of claim 1, wherein the packaged antenna module comprises a radio frequency chip, a dielectric substrate, and at least one first antenna radiator, wherein the radio frequency chip is further away from the bandwidth matching layer than the at least one first antenna radiator, the dielectric substrate carries the at least one first antenna radiator, and the radio frequency chip is electrically coupled with the at least one first antenna radiator via transmission lines embedded in the dielectric substrate.

5. The antenna assembly of claim 4, wherein the dielectric substrate comprises a first surface and a second surface opposite the first surface, wherein a minimum distance between the first surface and the bandwidth matching layer is smaller than a minimum distance between the second surface and the bandwidth matching layer, and wherein an orthographic projection of the bandwidth matching layer on the packaged antenna module and the at least one first antenna radiator at least partially overlap.

6. The antenna assembly of claim 5, wherein each first antenna radiator comprises at least one feeding point, wherein each feeding point is electrically coupled with the radio frequency chip via the transmission lines, and for each feeding point of each first antenna radiator, a distance between the feeding point and a center of the first antenna radiator is larger than a preset distance.

7. The antenna assembly of claim 4, wherein:

the dielectric substrate comprises a first surface and a second surface opposite the first surface, wherein the at least one first antenna radiator is disposed on the first surface, and the radio frequency chip is disposed on the second surface; and the packaged antenna module further comprises at least one second antenna radiator embedded in the dielectric substrate, wherein the at least one second antenna radiator is spaced apart from the at least one first antenna radiator, and the at least one second antenna radiator is coupled with the at least one first antenna radiator to form a stacked patch antenna.

8. The antenna assembly of claim 4, wherein the bandwidth matching layer is longer than the first antenna radiator by a half of a wavelength of the millimeter wave signal in the target frequency band and wider than the first antenna radiator by the half of the wavelength of the millimeter wave signal in the target frequency band.

9. The antenna assembly of claim 4, wherein the dielectric substrate further defines a plurality of metallized via grids arranged around each first antenna radiator to improve isolation between each two adjacent first antenna radiators.

10. The antenna assembly of claim 1, wherein the packaged antenna module comprises at least one or more of the following: a patch antenna, a stacked patch antenna, a dipole antenna, a magnetic dipole antenna, and a quasi-Yagi antenna; and wherein the bandwidth matching layer comprises at least one stacked dielectric layer.

11. An electronic device, comprising:

a packaged antenna module configured to transmit and receive, within a preset direction range, a millimeter wave signal in a target frequency band; and a bandwidth matching layer spaced apart from the packaged antenna module, wherein at least part of the bandwidth matching layer is disposed within the preset direction range, the bandwidth matching layer is configured to match an impedance of the packaged antenna module to an impedance of free space to enable an impedance bandwidth of the packaged antenna module in the target frequency band when the bandwidth matching layer is provided to be greater than an impedance bandwidth of the packaged antenna module in the free space, and wherein the bandwidth matching layer comprises at least one of: a battery cover covering a battery of the electronic device, and a cover plate covering a display screen of the electronic device, and wherein a distance between the bandwidth matching layer and the packaged antenna module is smaller than a quarter of a wavelength of the millimeter wave signal in the target frequency band.

12. The electronic device of claim 11, wherein the packaged antenna module further comprises a mainboard disposed on a side of the packaged antenna module away from the bandwidth matching layer, and the mainboard is provided with a ground electrode to prevent the millimeter wave signal in the target frequency band from being radiated toward the mainboard.

13. The electronic device of claim 11, wherein a dielectric substrate forms a part of a mainboard of the electronic device, and the packaged antenna module is integrated in the mainboard of the electronic device.

14. The electronic device of claim 11, wherein the electronic device comprises a millimeter wave antenna array with M×N antenna assemblies, wherein M is a positive integer and N is a positive integer.

15. An electronic device, comprising:

a first packaged antenna module configured to transmit and receive, within a first preset direction range, a millimeter wave signal in a first target frequency band;

a second packaged antenna module spaced apart from the first packaged antenna module, wherein the second packaged antenna module is disposed outside the first preset direction range, and the second packaged antenna module is configured to transmit and receive, within a second preset direction range, a millimeter wave signal in a second target frequency band; and a bandwidth matching layer spaced apart from the first packaged antenna module and the second packaged antenna module, and the bandwidth matching layer is at least partially within the first preset direction range and at least partially within the second preset direction range, and wherein the bandwidth matching layer is configured to match an impedance of the first packaged antenna module to an impedance of free space to enable an impedance bandwidth of the first packaged antenna module in the first target frequency band when the bandwidth matching layer is provided to be greater than an impedance bandwidth of the first packaged antenna module in the free space and an impedance bandwidth of the second packaged antenna module in the second target frequency band when the bandwidth matching layer is provided to be greater than an impedance bandwidth of the second packaged antenna module in the free space, wherein a distance between the bandwidth matching layer and the first packaged antenna module is smaller than a quarter of a wavelength of the millimeter wave signal in the first target frequency band, and a distance between the bandwidth matching layer and the second packaged antenna module is smaller than a quarter of a wavelength of the millimeter wave signal in the second target frequency band.

16. The electronic device of claim 15, wherein the bandwidth matching layer comprises a battery cover covering a battery of the electronic device, wherein the battery cover comprises a rear plate and a frame bent and extending from a peripheral edge of the rear plate, and wherein one of the following:

the rear plate is at least partially within the first preset direction range and at least partially within the second preset direction range;

the frame is at least partially within the first preset direction range and at least partially within the second preset direction range;

the rear plate is at least partially within the first preset direction range, and the frame is at least partially within the second preset direction range; and the frame is at least partially within the first preset direction range, and the rear plate is at least partially within the second preset direction range.

17. The electronic device of claim 15, wherein a relationship between a thickness h_cover of the bandwidth matching layer corresponding to the first packaged antenna module within the first preset direction range and a dielectric constant Dk of the bandwidth matching layer is:

$$\frac{\lambda}{2\sqrt{Dk}} > \text{h_cover} \geq \frac{\lambda}{2\pi(Dk-1)},$$

wherein λ represents a wavelength of the millimeter wave signal in the first target frequency band.

18. The electronic device of claim 15, wherein the bandwidth matching layer comprises a curved cover plate covering a display screen of the electronic device, wherein the curved cover plate comprises a body portion and an extending portion bent and extending from a peripheral edge of the body portion, and wherein one of the following:

the body portion is at least partially within the first preset direction range and at least partially within the second preset direction range;

the extending portion is at least partially within the first preset direction range and at least partially within the second preset direction range;

the body portion is at least partially within the first preset direction range and the extending portion is at least partially within the second preset direction range; and the extending portion is at least partially within the first preset direction range and the body portion is at least partially within the second preset direction range.

* * * * *